US012630204B2

(12) United States Patent
Hilleary

(10) Patent No.: US 12,630,204 B2
(45) Date of Patent: May 19, 2026

(54) PREDICTIVE RAILROAD CROSSING SAFETY NOTIFICATION AND TRAFFIC CONTROL SYSTEM AND METHODS

(71) Applicant: THE ISLAND RADAR COMPANY, Olathe, KS (US)

(72) Inventor: Thomas N. Hilleary, Lenexa, KS (US)

(73) Assignee: AJ Technologies LLC, Springville, UT (US)

( * ) Notice: Subject to any disclaimer, the term of this patent is extended or adjusted under 35 U.S.C. 154(b) by 662 days.

(21) Appl. No.: 18/054,572

(22) Filed: Nov. 11, 2022

(65) Prior Publication Data

US 2024/0157988 A1 May 16, 2024

(51) Int. Cl.

*B61L 29/30* (2006.01)
*B61L 25/02* (2006.01)
*B61L 29/32* (2006.01)

(52) U.S. Cl.

CPC ..... *B61L 29/30* (2013.01); *B61L 25/02* (2013.01); *B61L 29/32* (2013.01)

(58) Field of Classification Search

CPC ..... B61L 29/30; B61L 29/32; B61L 25/02
See application file for complete search history.

(56) References Cited

U.S. PATENT DOCUMENTS

| | | | | |
|---|---|---|---|---|
| 9,193,367 | B2 | 11/2015 | Hilleary | |
| 10,665,118 | B2 | 5/2020 | Hilleary | |
| 10,967,894 | B2 | 4/2021 | Hilleary | |
| 2019/0145791 | A1 | 5/2019 | Rempel et al. | |
| 2019/0337543 | A1* | 11/2019 | Corbo | B61L 27/40 |

FOREIGN PATENT DOCUMENTS

| | | | | |
|---|---|---|---|---|
| JP | 2012121569 A | * | 6/2012 | B61L 29/00 |

OTHER PUBLICATIONS

US Department of Transportation, Federal Railroad Administration, "Blocked Crossings Fast Facts" www.fra.dot.gov, (Nov. 2021).

* cited by examiner

*Primary Examiner* — Robert J McCarry, Jr.
(74) *Attorney, Agent, or Firm* — Armstrong Teasdale LLP

(57) ABSTRACT

A predictive railroad crossing system proactively improves railroad safety notification and traffic control decisions to avoid crossing-associated delays for a plurality of operating trains. The system is configured to iteratively respond to real-time operating data for the trains and identify public or private railroad crossings that each respective operating train will approach. An estimated time of arrival and estimated of blocked crossing duration time is made predictively for each of identified public or private railroad crossings without any physical train detection in at least some of the identified public or private railroad crossings.

61 Claims, 21 Drawing Sheets

PREDICTIVE RAILROAD CROSSING SAFETY NOTIFICATION AND TRAFFIC CONTROL SYSTEM AND METHODS

BACKGROUND OF THE INVENTION

The field of the invention relates generally to intelligent traffic control safety systems and methods, and more specifically to intelligent processor-based systems and methods that enhance safety at railroad crossings and enable enhanced vehicle navigation routing and dispatch by predictively determining, without requiring physical train-detection systems at each of a plurality of railroad crossings, an estimated time of train arrival at the plurality of different railroad crossings and a respective duration of blocked railroad crossings by the respective trains at each crossing.

Railroad crossing detection and notification systems are known that physically sense and detect an actual presence of a locomotive train as it approaches an intersection of a railroad track (or tracks) and a road surface for automotive vehicle use, referred to herein as a rail grade crossing. While such known railroad crossing detection and notification systems do improve safety of locomotive train passage, roadway vehicle passage, and any workers or pedestrians in and around crossings where they are installed, they tend to be cost-prohibitive for many crossing locations. As a result, many railroad crossings today lack any ability to sense train presence or to notify motorists or persons at the crossing sites of oncoming trains.

Existing railroad crossing detection and notification systems that operate in response to physical train detection at the crossing also undesirably cause substantial vehicular traffic disruption and inefficiency due to crossing detection and notification systems operating shortly before the actual train arrival at the crossing. Operation of such systems shortly before the train arrives is a design feature of conventional railroad crossing detection and notification systems, but it consequentially means that there is very little lead time for vehicle traffic systems and drivers to avoid seemingly unpredictable train movements resulting in blocked railroad crossings.

Affordable and effective railroad crossing safety notification systems with longer lead times to facilitate improved crossing safety and improved vehicle traffic system efficiencies and enhancements are therefore desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
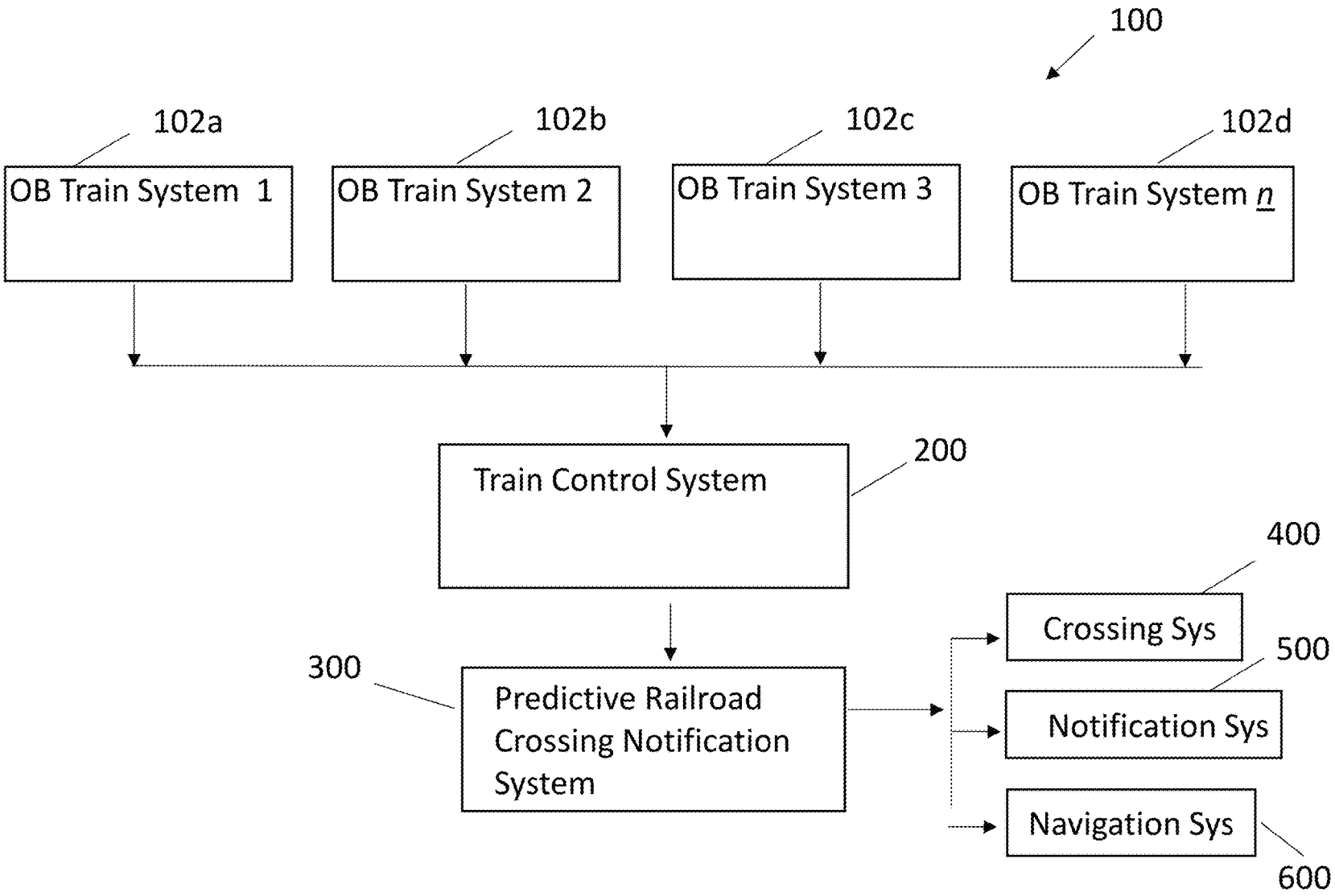
FIG. 1 is a block diagram of an intelligent processor-based predictive railroad crossing safety notification and traffic control system according to a first exemplary embodiment of the present invention.

In order to understand the systems and methods of the invention to the greatest extent, set forth below is a discussion of the state of the art of railroad crossing detection and notification systems and substantial longstanding but unresolved problems in the art, followed by a disclosure of exemplary inventive processor-based systems and methods beneficially overcoming the limitations of conventional railroad crossing detection and notification systems and methods.

I. State of the Art

Railroad crossing detection and notification systems are well known and have long been used to detect a locomotive train via physical sensor system as a train approaches certain intersections of a railroad track (or tracks) and roadway surface for automotive vehicle use, referred to herein as a rail grade crossing. Different variations of known crossing detection and notification systems are in current use across the United States at public and private crossings.

The United States currently has more than 130,000 public at-grade railroad crossings. About half of these public crossings have active crossing warning systems including flashing lights and/or barrier gates to warn motorists of arriving trains and to prevent roadway vehicles from entering into the crossing in the path of a train. More specifically, about 35% of public crossings have flashing lights and gates, and about 16% have flashing lights with no gates. While such active warning systems significantly improve safety at the crossings where they are installed, they are not infallible. More than 60% of train-automobile collisions occur at public crossings with active warning systems, a portion of which are attributable to driver error or disobedience. Drivers have been known to race the train to the crossing. ignore safety notifications, or drive around barrier gates when there is seemingly no train in sight. Higher speed trains, however, may descend on the crossing much more quickly than drivers anticipate.

Public crossings with passive warning systems also exist, which include the use of crossbucks (the familiar x-shaped signs that mean yield to the train), yield or stop signs, and pavement markings. Passive warning systems depend primarily on the vigilance of motorists proceeding through the crossings, but on occasion drivers again can be tempted to beat the train to the crossing to avoid delay of the crossing being blocked, or fail to see or appreciate how soon the train will be at the crossing.

In addition to public crossings, there are almost 80,500 private railroad crossings, most of which do not have active crossing warning systems, and which account for approximately 40% of train-automobile collisions. Again, a portion of the collisions at the crossings are due to driver error in trying to clear the crossing before the train arrives in order to avoid delay of the train passing through the crossing.

In many cases, railroad crossing detection and notification systems are owned and controlled by a railroad operator. Known railroad-owned and controlled crossing detection and notification systems are designed, however, predominately from a safety perspective at each crossing where they are installed. Railroad-owned and controlled crossing detection systems are typically employed selectively in certain high traffic volume urban corridors presenting significant safety concerns from the railroad's perspective, but for crossings in many lower volume traffic areas such as smaller municipalities and rural areas, railroad-owned and controlled detection and notification systems are cost-prohibitive and are not utilized. Potential funding for such railroad-operated and controlled detection and notification systems by towns cities and municipalities for hardware and equipment maintenance is often prohibitively high.

Existing railroad crossing active warning systems benefit the railroad organization and also vehicle drivers in safety aspects aimed to avoid train-vehicle collisions. From the perspective of vehicle traffic flow, however, active warning systems present substantial disruption and delay, and sometimes unnecessary disruption and delay to vehicular traffic in the vicinity of the railroad crossing where such active warning systems are operating. The active warning systems may operate in a seemingly unpredictable manner to many drivers, vehicle navigation and routing systems, or to vehicle dispatch systems. In addition, known active warning systems tend to operate with very little lead time for drivers, vehicle navigation systems and routing systems, or vehicle dispatch systems to consider and evaluate alternative routes that may optimally avoid a blocked crossing by an arriving train. The same is generally true for passive warning systems in that drivers and vehicle routing systems may be effectively surprised by an arriving train with very little lead time to react before traffic is stopped.

Collectively, trains moving through railroad crossings block vehicular traffic at a rate of more than 1,800,000 times per day. According to the FRA (Federal Railroad Administration) and the FHWA (Federal Highway Administration) these blocked crossing events idle traffic for between 66 million and 175 million hours per year. Since train length and speed can vary dramatically, from the driver perspective the amount of time (and corresponding delay) for any given train to clear the crossing is generally unpredictable, and in the event that a train temporarily stops moving drivers at the crossing face vast uncertainty when the crossing will be cleared for passage. As an indicator of the scope of this issue, and the annoyance imposed upon the motoring public, in 2018, more than 50,000 cellphone calls were placed to BNSF Railroad alone inquiring about how long a crossing was going to remain blocked because of a moving or stationary freight train.

As a further indicator of the scope of the problems that are presented by blocked crossings, the Federal Railroad Administration (FRA) has a webpage for the public and law enforcement to report blocked crossings by date, time, location, and duration. See https://www.fra.dot.gov/blockedcrossings/. Data highlights provided through November 2021 for blocked crossing events reported through the webpage are reported by the Office of Railroad Safety at https://railroads.dot.gov/elibrary/blocked-crossings-fast-facts. In the November 2021 report, the Office of Railroad Safety states that data collected from the webpage "helps FRA to identify where chronic problems exist and to better assess the underlying causes and overall impacts of blocked crossings." FRA further seeks to facilitate "local solutions with railroads and local authorities", yet such solutions have yet to be realized.

Apart from travel disruption and delay associated with blocked crossings, idled traffic in the range of 65 million to 175 million hours is undesirable from other perspectives, including but not limited to unproductive fossil fuel consumption and undesirable vehicle emissions of idled traffic that may present public policy concerns from environmental, climate and energy policies to local, state and federal authorities. The public at large may therefore benefit from an effective solution to idled traffic due to trains moving through railroad crossings.

Third party (i.e., non-railroad entity) train detection and notification systems have been developed that operate independently from railroad-operated train detection and notification systems, and such third party systems may be utilized in tandem with railroad-operated train detection systems at certain crossings to add additional functionality or at railroad crossings where no railroad-operated train detection system exists. For example, radar-based sensing systems are available from Island Radar LLC of Springville, Utah (https://www.islandradar.com/) that may be installed above-ground and operated reliably with much lower cost than most railroad-operated train detection systems including long track circuits integrated in the railroad tracks and buried inductive loops in the railroad right-of-way, for example. As such, third party train detection and notifications systems may be advantageously retrofit to crossings where the railroad itself has not provided any of its own equipment to detect a train or warn motorists of an arriving train.

In some cases train speed detection is possible at the crossing where train detection systems are installed, but in a site specific manner that precludes sensed train speed changes before or after that train reaches the specific site. As such, very limited predictive ability exists within a short time window before the train actually reaches the roadway for the crossing concerned, and sufficient lead time for proactive decision making to avoid crossings with imminent train arrival is not possible. Additionally, existing train detection systems tend to rely on stand-alone wireless communications systems to harvest train movement information, which can sometimes be unreliable and therefore unsuitable for reliable predicting train arrival for the benefit of roadway vehicles.

U.S. Pat. Nos. 10,665,118 and 10,967,894 of Island Radar, the disclosures of which are hereby incorporated by reference in their entirety, teach physical detection of trains utilizing third party supplied radar and infrared detectors, and communication of impending roadway blockages to a crossing ahead of those detection points to signage located at the crossings for the benefit of motorists. The crossings outfitted with radar and infrared detectors or sensors may or may not include active warning systems of the railroad operator. While costs of installation of such a third party train detection is lower than the cost of installing a typical railroad-operated train detection system including track circuits and the like to detect train presence, the cost can still be significant at it requires the installation of equipment at specific points along the railroad right-of-way, along with power, wireless communication links, and dynamic signage. Simpler and lower cost third party solutions are desired.

As explained in U.S. Pat. Nos. 10,665,118 and 10,967,894 of Island Radar, conventional track circuits typically extend up to several thousand feet away from a crossing in both directions, and are typically configured to activate active crossing warning systems with a pre-designated warning time of 20-30 seconds or 40-60 seconds based on crossing location and train speed. Track circuits operate on limited sections of railroad tracks via electrical connections to the rails of the tracks concerned. Track circuit techniques apply signals as a set of frequencies to the rails of each track and monitor a return signal path to detect a presence of a train. As the train is approaching the crossing, the conductive, metal axles at the front of the train electrically shunt or short the rails together and alter the spectral characteristics of the signals applied to the tracks. Accordingly, the frequency makeup of the signals from the tracks at the return path changes and the presence of the train can be detected. These changes provide the track circuit based train detection equipment in the railroad train detection system with an ability to determine how far away the approaching locomotive of the train is and also at what speed it is traveling. While effective to provide a 20-60 second warning time at the crossing, such 20-60 second warning time is woefully insufficient from a traffic control perspective wherein idled traffic at blocked crossings is desirably avoided. The third party supplied radar and infrared detectors may be placed outside the operating range of a track circuit to extend the warning time further (e.g., for an additional 20-30 second period) to accommodate higher speed trains, the total warning time (e.g., less than two minutes) is still nowhere near long enough to effectively reduce idled traffic at blocked crossings.

To some extent, traffic control measures are also possible with third-party train detection systems as further described in U.S. Pat. Nos. 10,665,118 and 10,967,894 of Island Radar. For example, Island Radar has proposed a train detection system that beneficially avoids unnecessary vehicle traffic disruption along roadways adjacent to railroad crossings but which do not themselves cross railroad tracks that are occupied by a train. Also, the associated traffic control improvements taught in U.S. Pat. Nos. 10,665,118 and 10,967,894 are generally limited to signalized intersections with adjacent roadways that are predominately found in higher traffic volume urban corridors. A large number of crossings without signal lights and/or without adjacent roadways exist in which such traffic control measures cannot be employed. More universally applicable traffic solutions are therefore desired.

For vehicles that do need to pass through the crossing, the systems of U.S. Pat. Nos. 10,665,118 and 10,967,894 will still operate shortly before the train arrives in a seemingly unpredictable manner to motorists at the crossing, and the amount of time that will be required for the train to clear the crossing is unknowable from the driver perspective. Improvements are accordingly desired that can operate with greater clarity and transparency from the driver perspective for both train arrival time and blocked crossing duration with an extended lead time for drivers and vehicle systems to proactively manage blocked crossing delays via enhanced notifications that, in turn, facilitate route selection and dispatching options that were not previously possible.

Both railroad-operated and third party train detection systems at crossing sites typically require continuously supplied hard-wired electrical power in order to reliably operate. Many railroad crossings exist, however, at locations where hard-wired electrical power at the site of the railroad crossing does not exist. Running electrical power cables to such railroad crossing sites is possible to retrofit a crossing with a third-party train detection system, but this is impractical in many cases, and as such existing third party train detection systems are limited in their application to only certain crossings where electrical lines already exist or can be economically provided. Especially for many rural, passive (non-signalized) crossings with no proximate commercial power and poor cellular data communications coverage, significant barriers to the use of conventional train detection systems exist.

Affordable third party railroad crossing notification systems are therefore desired that are not as dependent on conventional train sensors are more versatile for use at railroad crossing locations and that do not require extensive electrification at each electrical crossing in order to operate.

Mandated by Congress as part of the Rail Safety Improvement Act of 2008 (RSIA), railroad entities have largely implemented a Positive Train Control system (hereinafter "the PTC system") across the nation's rail corridors. The primary objective of the PTC system is to prevent train collisions with one another, over-speed derailments, incursions into railroad worker zones, and movements of trains through switches left in the wrong position. The PTC system is implemented across a dedicated private radio infrastructure across more than 57,000 miles of main line track corridor operating on a licensed radio spectrum, with encrypted messaging and multiple wireless communication fallback systems to ensure reliable operation. Specifically, data communications in the PTC system are made via triple-redundant wireless communications from trains utilizing 220 MHZ and dual cellular system failover channels.

Railroad entity PTC systems must be sufficiently accurate and failsafe in order to maximize the safe operation of the nation's railroads. Real-time track corridor information is transmitted to locomotive onboard route computers and to railroad dispatch operation centers. In addition, locomotive location and operating metrics including, but not limited to, speed, length, and global positioning system (GPS) location are regularly transmitted to railroad dispatch centers via the PTC system. Constantly evaluated against the onboard route mapping systems, the PTC system enforces train speeds and can override train engineer actions to assure safe train operation, minimizing the possibility of train collisions and derailments.

As such, the PTC system is directed to railroad-entity interests concerning operation of the locomotive trains. The PTC system is not focused, however, on concerns for roadway vehicles (e.g., passenger cars and trucks, commercial vehicles, and emergency response vehicles) at blocked railroad crossings wherein a roadway intersects one or more railroad tracks. As noted above, railroad-operated crossing detection and notification systems with active warning features exist, which operate independently from the PTC system using sensors to detect trains as they approach each crossing, to protect the railroad's interests where the expense of installing and operating such systems is deemed justified by the railroad operator. The purpose and intent of such railroad-operated crossing detection and notification systems is to disrupt or block roadway traffic at the crossings in favor of safe passage of trains.

Because the railroad-entity centralized dispatch centers have real-time awareness of every train operating on PTC-enabled tracks, data and information collected by the PTC system could possibly be used to predict which railroad crossings are going to be occupied and for what duration without requiring any additional railroad equipment or third party equipment to physically detect train presence and movement at the site of each crossing. That is, train presence at crossings could be predicted based on train location, heading and speed known by the PTC system without utilizing a powered sensor system (either a railroad-based detection system or third party detection system) at the crossings. Such predicted arrival of the train at the crossing could in turn, facilitate control decisions to take appropriate measures at a crossing and/or to notify motorists of a blocked crossing in advance of the train's arrival at a crossing, both for safety concerns and for vehicle navigation concerns to reduce traffic disruption and traffic flow inefficiencies. This could be beneficial for crossings with and without active or passive crossing warning systems. Specifically, such predicted arrival of the train could be made with a longer lead time to make control decisions than existing train detection systems permit, or to facilitate control decisions based on train arrival information that was not previously available, including but not limited to vehicle routing decisions for passenger vehicles, commercial vehicles and emergency vehicles.

While the railroads have situational awareness of trains operating across their respective corridors via the PTC system, significant barriers exist to harnessing such awareness for predictive crossing notification purposes or for vehicular navigational aids, route optimization, and Emergency Medical Service (EMS) dispatching efficiency and for dispatching of other emergency responders (e.g., police and firefighters) for several reasons.

For many crossings along any given corridor train ETA prediction and blocked crossing duration prediction is of no practical interest to the railroad or the PTC system and as such these predictions are not generated by railroad operators. As such, for a host of crossings that presently exist, the PTC system does not include supporting data to simply or easily determine train ETA or blocked crossing duration estimates.

For certain crossings where train ETA information may be of interest to a railroad operator and is therefore known by a railroad operator, railroad entities are reluctant to provide crossing ETA information or supporting data for crossing ETA information out of concern for possible liability associated with any form of train-vehicle accident that may be associated with railroad-provided data. Railroad-entities are also understandably highly protective of train location information that could be used maliciously by any person or persons intent on disrupting rail transportation. Railroad entities are open, however, to providing minimum, basic data from PTC systems to third parties that do not raise liability concerns or security concerns to the railroad, but to date no one has overcome the significant obstacles that exist to reliably predict crossing ETA for trains and blocked crossing estimates for such a large number of trains captured on the PTC system headed toward disparate crossings on different sets of railroad tracks at any given point in time.

If the track distance between a current train location and a crossing could be accurately determined, an Estimated Time of Arrival (ETA) can be determined for the train to reach the crossing(s) ahead of it when the train location and train speed are each known. Of course, the train location and train speed are both known to the PTC system The duration of the crossing blockage by the train can also be determined when the train length is known, which is also recorded in the PTC system. The general public, however, generally lacks train location information or train routing information to inform the analysis of estimated time of train arrival at a crossing with confidence. Indeed, and as mentioned above, the railroad operators prefer that specific train location data not be directly communicated externally from the PTC system in a manner that malicious actors could exploit. This considerably complicates any attempt to determine a track length (and travel time based on track length) between a current train location and any upcoming crossing.

Railroad tracks have conventionally included Mileposts that could be a basis to compute a track length between a current train location and any upcoming crossing, but in view of rail corridor modifications and optimizations the Mileposts in many cases are no longer reliable indicators of track length. Train ETA estimates that rely on Milepost data are therefore subject to error. Of course erroneous ETA estimates would present another form of traffic disruption and inefficiency, as well as safety concerns if motorists choose not to reply upon train ETA estimates that may be unreliable.

There are also practical challenges to the public in identifying the precise location of crossings along railroad corridors in which trains are operating. If either the beginning point (actual train location) or the ending point (the crossing of interest) cannot be reliably determined, a reliable train ETA or blocked crossing duration estimate cannot be determined for any particular crossing.

Affordable, effective and reliable railroad crossing notification system improvements are therefore desired that improve crossing safety without necessarily relying upon conventional train detection sensors at the site of a railroad crossing or throughout a corridor extending out and away from respective railroad crossings, that do not require extensive electrification at each electrical crossing in order to operate, and that facilitate proactive crossing management for vehicle routing purposes to reduce inefficiencies and traffic disruptions at railroad crossings.

II. Inventive Predictive Crossing Systems and Methods

Inventive embodiments of independent third party, non-railroad data-driven predictive railroad crossing safety notification and vehicle traffic management systems and methods are described below which overcome the numerous technical problems and issues described above. The inventive systems and methods advantageously realize lower cost yet reliable crossing safety notification system improvements at a significantly greater number of railroad crossings while also intelligently realizing substantial traffic control system improvements at railroad crossings that may be implemented in a versatile manner across existing railroad crossings without restriction.

Operating upon a subset of data and information maintained by railroad centralized dispatch centers through their respective PTC systems, train ETA and blocked crossing time estimation is meaningfully provided by the inventive systems and methods for the benefit of improved railroad crossing safety, vehicle navigational aid, route optimization systems, Traffic Message Channel system communications, and EMS routing. Additionally, active crossing warning systems may be activated (as enhancements to existing railroad-owned crossing warning systems or to existing crossing where only passive warning systems are in place, or as stand-alone retrofit systems to crossings having no active or passing warning system in place), roadside signage may activated, in-auto driver alerts may be delivered, and alerts may be received by personal devices of non-drivers. Communications and messaging, including alternate route information to avoid blocked crossings and associated travel delays to reach a destination, are synthesized across a variety of platforms to maximize system and method versatility to reach as many interested persons as possible.

The inventive systems and methods described herein provide accurate train ETA and blocked crossing time estimation for trains that are, for example, at least 10-20 miles away (or further) from crossings of interest. This in turn, means that the inventive systems and methods can effectively provide at least 10-20 minutes (or longer) lead times to notify vehicle systems, traffic systems, and personal devices, for example and allow vehicle systems, operators, drivers, and persons ample lead time to make decisions and take needed actions to avoid blocked crossings. Significantly, extended lead times of at least about 10 times to more than 100 times of existing railroad-operated train detection systems which provide a lead time in a range of 20-60 seconds systems provides for proactive management of train arrival and blocked crossing probabilities that was not previously possible.

In the inventive systems and methods of the invention, technical complexities of resolving ambiguities in data that railroad entities are willing to share are solved for the significant benefit of conveying real-time transparency in expected crossing blockages by trains and expected durations of blocked crossings by trains in a manner that heretofore has not been possible. As such, technological solutions to technological problems in the railroad industry and in the vehicle navigation and vehicle dispatch industries are realized by the inventive systems and methods of the invention in a manner that is neither routine or conventional in the pertinent field of endeavor. Predictive blocked crossing information is not only reliably generated to solve technical problems and drive technical improvements, but the predictive blocked crossing information is integrated into numerous practical applications in real-world devices and systems.

The systems and methods described below advantageously provide accurate, real-time information regarding impending train arrival at active or passive, public or private railroad crossings. Such real-time information can, in turn, facilitate traffic proactive control decisions to improve crossing safety and reduce traffic idling at crossing. Vehicle route optimization options are made possible by predictive train ETA and blocked crossing estimates, opportunities for train-automobile accidents are reduced, active lighted or audible train arrival signage at previously passive crossings is possible, communications of impending train arrival information can be made to vehicle-based alert devices or systems, and emergency vehicle dispatch control decisions can be made to improve response time and avoid delays.

For example, predictive train ETA and blocked crossing estimate information may by output in systems and method of the invention to facilitate more optimal decision making in GPS Navigation systems that provide route optimization features (e.g., Waze, Garman, TomTom, Sirius). Emergency dispatch operation centers, Traffic Message Channel providers (RDS, Sirius), and Intelligent Transportation Systems (ITS) for conveyance through Infrastructure to Vehicle (I2V) subsystems may also benefit from predictive train ETA and blocked crossing estimate information. Motor vehicle operators may proactively alter their routes prior to train arrival at a crossing to avoid delay with advanced knowledge of predictive train ETA and blocked crossing estimate information. Optimized routes enabled by the predictive train ETA and blocked crossing estimate information, in turn, beneficially reduce adverse environmental effects caused by idling traffic at crossings. Millions of hours per year of idled vehicles at railroad crossings can beneficially be reduced.

For the benefit of the railroad industry, informing drivers ahead of time about impending crossing activations by the systems and methods of the invention advantageously empowers drivers to consider taking different routes to avoid crossings when trains are present. By reducing instances that vehicles and motorists are at the same crossings at the same time, a likelihood of train-vehicle collisions is inherently reduced, and railroads may operate with an increased degree of safety and efficiency.

Predictive train ETA and blocked crossing estimate information generated by the systems and methods of the invention further facilitates an optimization of emergency dispatch and routing to minimize a likelihood, for example, that fire and EMT response personnel are not unnecessarily delayed by trains arriving at crossings in an unexpected manner. EMS dispatch efficiency can therefore be significantly improved.

In some beneficial aspects of the present systems and methods, at passive crossings where there are no track circuits or commercial power to utilize active crossing warning systems, time-of-arrival information derived from real-time PTC data can be used to activate lighted, solar-powered signage, thereby advising motorists in rural areas and at private passive crossings of impending train arrival at those crossings. Locally broadcasted train arrival information can also be transmitted to automotive ITS (Intelligent Transportation Systems) using Dedicated Short Range Communication Systems (DSRC) systems and to other in-car alert devices utilizing, for example, low-power Bluetooth and other communication technologies.

The real-time and real-world, end use applications of the systems and methods of the invention as summarized above are enabled by predicting crossing activation time and duration, and synthesizing information including, with accounting for changes in train speed over time: (i) estimated times of crossing activation (and hence, roadway blockage) for a number of trains operating at any given time with respect to associated crossings that the trains are approaching; (ii); estimated duration of crossing activation (based on train velocity and train length) at specific crossing locations; and (iii) communicating estimation data to specific systems and devices at the locations of each affected crossing (i.e., roadway/railroad intersection) of interest and to vehicles and systems for vehicles in the general vicinity of crossings of interest to assess route impact and options for enhanced routing to avoid blocked crossings, including for example only GPS location data of particular crossings, cross street data, Municipality and State data, etc.

In contemplated embodiments, basic information that railroads are willing to share for the purposes of the inventive systems and methods includes for example, on ten-minute update intervals: (i) Current train location data by Division, Subdivision, Branch, and Milepost of particular railroad corridors; (ii) Train speed and heading; and (iii) Train length. Instead of making such data generally available to the public, however, railroads are willing to provide such data, and only the minimum data necessary, on the condition that it is made available only to a trusted broker, or intermediary system, which can consume PTC-sourced train information from multiple railroads, appropriately anonymize the train data, and securely distribute the information as necessary to the end applications such as those described above and below.

Operating as a trusted broker node interfaced with PTC systems of railroad operators, a railroad-independent system configured as a computer server in contemplated embodiments of the inventive systems and methods, resolves and delivers train ETA and blocked crossing duration information for use by vehicle navigational aid systems and other important dispatch systems and notification devices. Such resolutions and delivery of train ETA and blocked crossing duration information is accomplished via correlating railroad-provided train location speed, length and heading with information maintained by other databases (for instance the Federal Railroad Administration's Crossing Inventory Database) that provide static crossing location information for a vast number of public or private crossings in terms of GPS coordinates, Division/Subdivision/Branch/Milepost, Cross-streets, and Municipality. Speed and heading information provided by the railroad PTC database allows the trusted broker node to calculate time of arrival at a crossing, by converting Milepost data to their GPS equivalents. Train length and speed information can be used to calculated expected duration of crossing blockage that may be expected once the train has reached the crossing island. Frequent updates (in a range of two to ten minutes for instance) can continuously correct for variances in train velocity along the route.

Once the train arrival time at identified crossings is determined along with the estimated time a locomotive will block each crossing once it arrives, this information may be used for purposes beyond alerting drivers of traffic blockage at crossings through navigational aids. For example, and as previously mentioned, such information may be communicated to local emergency vehicle dispatch centers which can then be sure the chance emergency vehicles may be slowed or halted can be minimized.

In another aspect of the inventive systems and methods, the thousands of rural crossings that do not have electricity or railroad infrastructure to support active crossings (lights and gates) can be outfitted with lighted signage that will alert drivers to the impending arrival of trains at each crossing in real-time. For example, information pertaining to the impending arrival of a train at a rural, passive crossing, can be communicated over secure cellular radio (5G for instance) which will then activate LED warning lights on signage proximate to the crossing to warn of the possible arrival of a train. The radio receiver and lighted signage equipment can be powered by solar panels with battery backup for use at crossings which do not have any nearby source of electrical power. Such electronic signage communicating train ETA and blocked crossing duration information also presents value added functionality to existing active warning crossing systems that do not have any predictive capability or ability to determine blocked crossing duration via the railroad-owned track circuit based sensor systems provided for the purpose of crossing warning system activation.

In other aspects of the inventive systems and methods numerous metadata can utilized dynamically to measure the overall reliability of the systems and methods in generating and communication accurate train ETA and blocked crossing duration estimates. Such metadata includes (i) GPS data from the railroad and from the FRA crossing inventory database which can also be used to dually validate locations of interest; (ii) actual train arrival (at a crossing) information can be used to constantly measure the accuracy of the system; and (iii) using machine learning, repetitive routes by the same trains can be "learned" by the system to constantly improve accuracy of predictive train ETA and blocked crossing duration estimates. As such, the systems and methods in these aspects defined improvements in the functioning of intelligent devices which determine the train ETA and blocked crossing duration estimates.

Turning now to the figures, exemplary embodiments of the systems and methods implemented with intelligent, networked, processor-based devices, systems and subsystems are described below. As used herein, the term "processor-based device" shall refer to computers, processors, microprocessors, microcontrollers, microcomputers, programmable logic controllers, reduced instruction set (RISC) circuits, application specific integrated circuits and other programmable circuits, logic circuits, equivalents thereof, and any other circuit or processor capable of executing the functions described below. The above examples are exemplary only, and are thus not intended to limit in any way the definition and/or meaning of the term "processor-based device".

The systems and processes of the present invention may be implemented as described in the following examples with one or more interfaced intelligent systems and processor-based devices including a microcomputer or other processor, and a memory that stores executable instructions, commands, and control algorithms, as well as other data and information required to satisfactorily operate the systems to realize the desired functionality described herein. The memory of the processor-based device may be, for example, a random access memory (RAM), other forms of memory could be used in conjunction with RAM memory, including but not limited to flash memory (FLASH), programmable read only memory (PROM), and electronically erasable programmable read only memory (EEPROM). Method aspects of the intelligent, networked, processor-based devices, systems and subsystems are in part apparent and in part explicitly discussed in the following description.

FIG. 1 is a block diagram of a computer-implemented predictive railroad crossing notification and traffic control system 100 according to a first exemplary embodiment of the present invention.

The system 100 is shown in FIG. 1 to include a plurality of onboard train systems 102*a*, 102*b*, 102*c*, 102*d*. Such onboard train systems 102*a*, 102*b*, 102*c*, 102*d* include sensors and controls that report a variety of detected information concerning the operation of a locomotive, the most pertinent of which for purposes of the present invention is train speed, train location, and train length that are each respectively reported to the train control system 200, which may be the Positive Train Control (PCT) system in an exemplary embodiment or another train control system that collects train operation data and information via means other than PTC enabled railroad tracks. The train systems 102*a*, 102*b*, 102*c*, 102*d* are generally known and for the sake of brevity are not further described herein, but such onboard train systems are realized via intelligent processor-based controls and computers that comprehensively monitor the operation of the train and communicate a host of data concerning the train operation via wireless connection to the control system 200 according to known radio frequency communication protocols.

The train systems 102*a*, 102*b*, 102*c*, 102*d* may correspond to different trains of the same railroad entity or to a combination of trains operated by different railroad entities. The system 100 is scalable to include reports from practically any number n of onboard train systems reporting to the train control system 200. When needed, the train control system 200 may issue override instructions responsive to contrary instructions issued to or generated by the onboard train system 200, with such override instructions communicated wirelessly from the train control system 200 to the respective onboard train systems 102*a*, 102*b*, 102*c*, 102*d* to ensure railroad safety and enforce speed limits or other concerns as applicable individually to the trains represented by the train systems 102*a*, 102*b*, 102*c*, 102*d*. The train control system 200 may intelligently oversee large numbers of trains operating in different areas. The train control system 200 is implemented in intelligent processor-based controls and computers at centralized location(s).

The train systems 102*a*, 102*b*, 102*c*, 102*d* are railroad operated and present the data and information from the train systems 102*a*, 102*b*, 102*c*, 102*d* which is not publicly available. The data and information in the train system 200 is likewise proprietary data and information of a railroad entity and is not publicly available data. In the system 100, however, the train control system 200 is in communication with an authorized, trusted predictive railroad crossing notification system 300 which advantageously determines train ETA and blocked crossing duration estimates based in part on train location data collected from the train control system 200 while appropriately safeguarding railroad interests and insulating them from reliability concerns. Such an authorized, trusted interface between the train control system 200 and the predictive railroad crossing notification system 300 advantageously renders it possible to provide train ETA and blocked crossing duration estimates universally to any crossing, and particularly to the many crossings that today lack any train sensor system or active warning system.

While GPS coordinates of each locomotive are known by each train system 102*a*, 102*b*, 102*c*, 102*d* railroad entities are reluctant to make them known as such simple disclosure of precise train location could potentially be exploited by malicious actors. In view of this, railroad entities would prefer to release other location data that can be indirectly used to determine train location in order to facilitate the desired train ETA and blocked crossing duration estimates. Such indirect determinations are a bit cumbersome but possible.

Apart from the GPS coordinates of the locomotive themselves, other location data on railroad corridors that is collected by the PTC system relates to the track(s) on which each train is travelling. Specifically, track locations are identified by Track Segment (including Division, Sub Division and Branch) and Milepost. Mileposts are historically standard points on a railroad's track infrastructure, and originally designated an actual distance (typically in tenths of mile) between contiguous Mileposts along the corridor. However, as railroads continue to optimize track corridors, for instance by straightening curves, building bridges, and creating tunnels, Milepost numbers have ceased to be representative of actual distance between Mileposts.

For example, a track section that originally included a long curve section might have had Mileposts that were numbered 48.1 and 52.5 at the ends of the curve section. In this example, the curved track distance between those Mileposts would have actually been 4.4 miles. But after the railroad straightened this curved track section to optimize the corridor, the actual track distance between the same Mileposts could be reduced to 3.0 miles. Because of all the hardcopy and electronic records associated with the Milepost locations and the various railroad assets along the corridor, the railroad would not rename/renumber these Mileposts as it would then require every Milepost before and after the curve to also be renumbered to realize accurate incremental distance along the entire corridor post-modification of the original curved section. To solve this problem, GPS coordinates have been assigned to the existing Mileposts because the original Milepost data points (reflecting the mileage from a predetermined starting point) may or may not be true indicators of track length between Mileposts or of a cumulative distance from the predetermined starting point along the railroad corridor.

The conversion of Mileposts to GPS coordinates makes it possible, but cumbersome, to indirectly determine an actual track distance between two points along the corridor (e.g., the current location of the train and a crossing ahead that the train is approaching) from the GPS coordinates of the mileposts located between the two points. A cumulative assessment of GPS coordinates between contiguous mileposts along the corridor is needed, however, and ambiguities will need to be resolved with route mapping information. For instance, the GPS coordinates themselves will not convey, for example, whether the track is straight or curved between any two Mileposts. Considering the previous example wherein a 4.4 mile long curved section was modified to a 3.0 mile long section via straightening of the track, the GPS coordinates of the associated Mileposts alone would not infer the correct track length distance between them.

In view of the above, simple mathematical operations on the GPS coordinates without accounting for actual route information may produce a mathematical track length that deviates from the real-world track length. Such errors may cascade along a route corridor and produce corresponding error in any attempt to predict train arrival at a crossing. The greater the deviation between predicted arrival times and actual arrival times, however, the greater the temptation for drivers to disregard such prediction, rendering such predictive estimates counterproductive. As described further below, however, exemplary embodiments of the system of the invention operates with respect to detailed crossing information and railroad routing information to determine accurate track length distances in combination with the Milepost data. The accurate track length distance can then be utilized with train speed and train length data reported by the train control system 200 to determine train ETA and blocked crossing estimates at various different crossings as further described below.

The system 100 is implemented in intelligent processor-based controls and computer devices, some at centralized location(s) and other dispersed at remote locations to one another and with respect to any centralized system(s) as further described below. Given the number of trains in operation, the number of railroad corridors for operating trains to run on, and the sheer number of crossings across the nation, more than one system 100 and/or more than one predictive railroad crossing notification system 300 could be provided to serve railroad traffic and roadway traffic in designated geographic areas, with each system 100 or 300 operating to produce train ETA and blocked crossing estimates for a smaller number of trains and a smaller number of crossings within predetermined geographic boundaries.

In contemplated embodiments of the system, train control system data is sampled periodically on a predetermined frequency (e.g., about every two minutes to about every ten minutes to meet particular needs) and train ETA's and blocked crossing estimates can be recalculated and recommunicated over time. This provides capability for intelligent machine learning and adjustments in determined train ETA's and blocked crossing estimates as real-world conditions change. For example, the system can methodically compare previously calculated train ETA's and blocked crossing estimates to prior calculated values, and based on the analysis of data over time the system may become probabilistic in its determinations of train ETA's and blocked crossing estimates for various different crossings over time. Patterns in train movements may be identified and factored into estimates generated.

As one example, when the estimates are generated every ten minutes, six estimates may be generated for a crossing in a one hour period when the train is sufficiently far away and/or travelling at a speed that the train will not reach the crossing in a one hour period. Hypothetically, the train ETA estimates for the same crossing over a one hour period may differ as follows beginning at an initial time $t_0$ of 12:00 pm. At time $t_0$ the train ETA may be one hour or at 1:00 pm. Ten minutes later at time $t_0$ the train ETA may be one hour from time $t_0$ or 1:10 pm. Another ten minutes later at time $t_2$ the train ETA may be one hour from time $t_1$ or 1:20 pm. Another ten minutes later at time $t_3$ the train ETA may be one hour from time $t_3$ or 1:30 pm. Another ten minutes later at time $t_4$ the train ETA may be one hour from time $t_4$ or 1:40 pm. Another ten minutes later at time $t_5$ the train ETA may be one hour from time $t_5$ or 1:50 pm. This pattern of increasing train ETA over time indicates that the train speed has been slowing down over the last 50 minutes. If this is identified as a repeated pattern from the data collected over time in the same general time period on different days, the predictive railroad crossing notification system 300 could override the next time $t_0$ estimate from 1 hour to 1 hour 50 minutes and adjust the estimates at times $t_1$, $t_2$, $t_3$ and $t_4$ so that the earlier estimates will match the last $t_5$ estimate.

In other examples, the system could identify patterns in the data where the train speed is increasing and estimated train ETA is growing smaller over time. In such a case, the predictive railroad crossing notification system 300 may adjust or reduce earlier estimates where the train is initially operating at a lower speed initially but arrives at the crossing with a higher speed. As another example, the system could identify a pattern in the data where the train speed is reducing and estimated train ETA is increasing over time, and in response the predictive railroad crossing notification system 300 may adjust or increase earlier estimates to account for the slowing of the train.

With such pattern recognition in the data and adjusting earlier ETA estimates to converge toward later ETA estimates in the patterns, the predictive railroad crossing notification system 300 could intelligently infer and account for under and over-estimation of ETA at each iteration to adjust ETA values at certain iterations to more probable values based on convergence in prior system data. While a predetermined sampling frequency of ten minutes is believed to be appropriate in providing enough data to make reliable estimates without overtaxing the system, both longer and shorter sampling frequencies are possible in further and/or alternative embodiments. Increasing or decreasing the sampling frequency in the aforementioned range of about two to about ten minutes may, in turn, result in varying degrees of sophistication and functionality based on different sets of different data.

Once train ETA and blocked crossing duration estimates are generated by the predictive railroad crossing notification system 300, they are communicated wirelessly to a respective crossing device or system 400 at one or more of the crossings to warn drivers at the crossing location of an approaching train at the crossing, to a respective notification device or system 500 to warn one or more persons (e.g., drivers, railroad workers at a crossing or pedestrians) of the approaching train, and to respective vehicle navigation devices or systems 600 to assess and consider possible route impact for routes in progress, or to assess alternative route options for new routes (i.e., routes that have not yet been started) to avoid delay of a train passing through the crossing. The devices or systems 400, 500, 600 are implemented in intelligent processor-based controls and computer devices as further described below.

Figure 2:
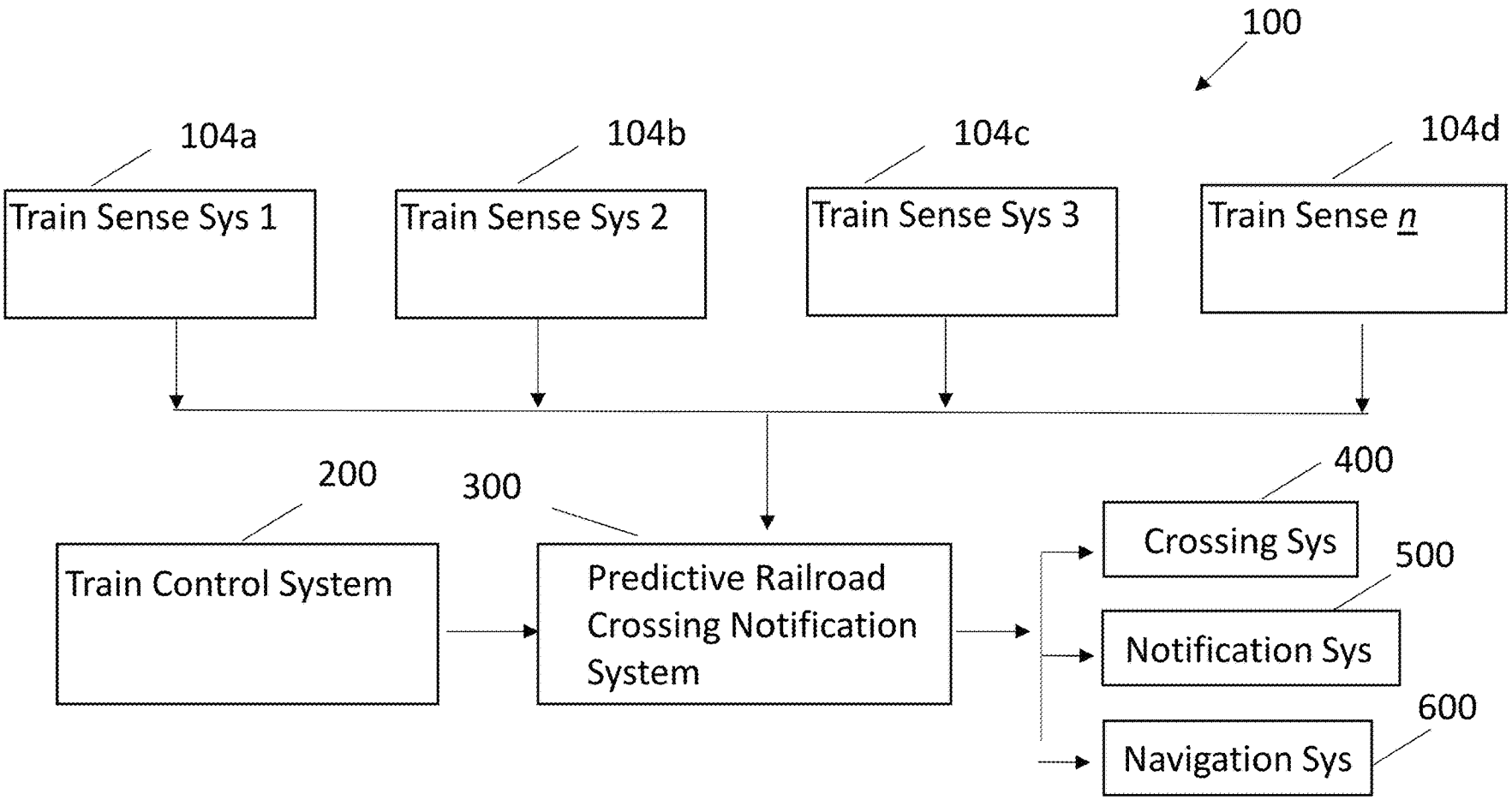
FIG. 2 is a block diagram of an intelligent processor-based predictive railroad crossing safety notification and traffic control system according to a second exemplary embodiment of the present invention.

FIG. 2 is a block diagram of the predictive railroad crossing notification and traffic control system 100 according to a second exemplary embodiment of the present invention that includes train sensing systems 104*a*, 104*b*, 104*c* and 104*d*. The train sensing systems 104*a*, 104*b*, 104*c* and 104*d* may be conventional crossing detection systems operated by the railroads or third parties at the site of specific crossings. Sensed train data from the systems 104*a*, 104*b*, 104*c* and 104*d* can be communicated to the predictive railroad crossing notification system 300, and provide a basis to evaluate the accuracy of predicted train ETA or estimated blocked crossing duration at the crossings where they operate. The systems 104*a*, 104*b*, 104*c* and 104*d* therefore provide a feedback loop to confirm an accuracy of predicted train ETA or estimated blocked crossing duration by the predictive railroad crossing notification system 300 which derives the estimates from data and information of the train control system 200. The feedback loop also provides for intelligent machine learning capabilities to adjust predicted train ETA or estimated blocked crossing duration in real-time as real-world conditions change.

For example, and in addition to comparing previously determined train ETA's and blocked crossing estimates as described above, the sensed train data from systems 104*a*, 104*b*, 104*c*, 104*d* may provide a further basis for probabilistic determination of train ETA's and blocked crossing estimates once a sufficient amount of data is collected and compared. For example, if train ETA estimates for a given crossing deviate 10% from actual time (as determined by systems 104*a*, 104*b*, 104*c*, 104*d*) of trains reaching the crossing, the system can begin to automatically add or subtract 10% as applicable to the estimates until the estimate times and actual times converge at the same value. This is another aspect of a self-learning or self-adjusting behavior of the system to generate reliable train ETA and blocked crossing duration estimate data. As such, while the systems 104*a*, 104*b*, 104*c*, 104*d* are only present at a subset of the railroad crossings that exist, they can serve as reliable and supplemental data points to make reliable train ETA estimates and blocked crossing estimates at crossings that do not include systems 104*a*, 104*b*, 104*c*, 104*d*. The system is scalable to include any number of systems 104*a*, 104*b*, 104*c*, 104*d*.

In another aspect, the train sensing systems 104*a*, 104*b*, 104*c*, 104*d* could provide sufficient data upon which the predictive railroad crossing notification system 300 could operate independent of a train control system such as the aforementioned PTC system. Considering that some existing train sensing systems 104 are capable of determining train speed and train length at known locations, they could provide data inputs for the predictive railroad crossing notification system 300 to generate train ETA estimates or blocked crossing duration estimates for subsequent crossings approached by the train in any specific railroad corridor.

Figure 3:
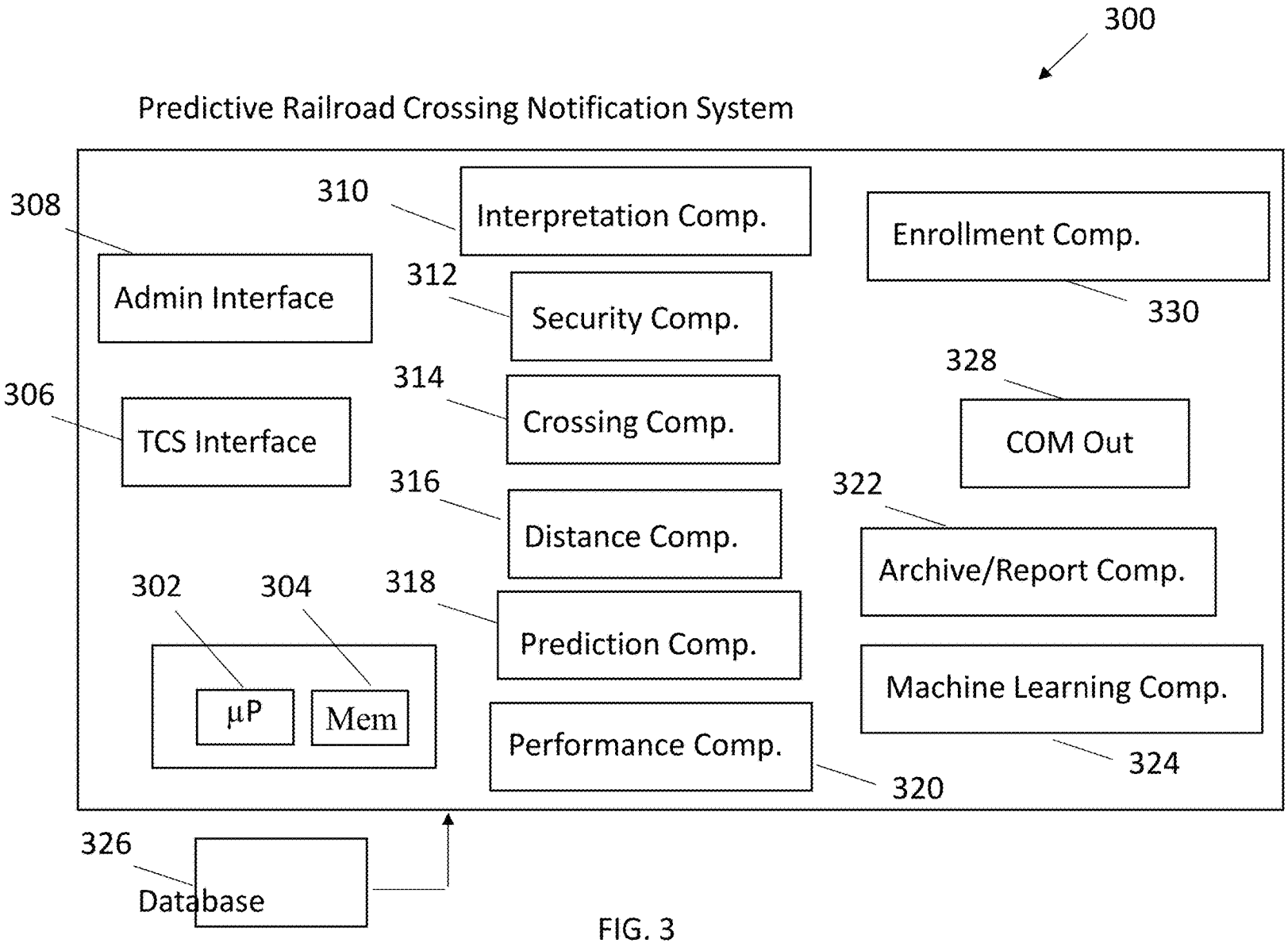
FIG. 3 is a block diagram of the predictive railroad crossing notification system shown in FIGS. 1 and 2.

FIG. 3 is a block diagram of the predictive railroad crossing notification system 300 in an exemplary embodiment. In contemplated embodiments, the predictive railroad crossing notification system 300 is configured as one or more computer servers including a processor 302 and a memory 304.

The predictive railroad crossing notification system 300 includes a Train Control System (TCS) Interface 306 for receiving data and information from the train control system 200 (FIGS. 1 and 2). In different embodiments, the TCS Interface 306 may be realized through wired and wireless connections, including but not limited to radio frequency signal transmission and cellular signal transmission of data and information, and networked computer connections including but not limited to the Internet. Data from the train control system 200 may be periodically output and received by the predictive railroad crossing notification system 300 and/or may be periodically queried and retrieved from the train control system 200 for purposes of the system 300. The predictive railroad crossing notification system 300 may also include an administrative interface 308 for predictive railroad crossing notification system operators and personnel to set system preferences, register users and enroll devices to receive notifications, manage notifications, perform updates, review activity logs and generate reports, and to implement other preferred features for use.

The predictive railroad crossing notification system 300 in the example shown includes a variety of components including interpretation components 310, security components 312, crossing components 314, distance components 316, prediction components 318, performance components 320, archiving and reporting components 322, and machine learning components 324. Each of the components 310 through 324 may be implemented in hardware, software or firmware components operable with respect to machine readable language or code segments executable by the processor to realize the functionality described herein.

The interpretation components 310 receive data and information from the TCS interface and perform any filtering, reformatting or processing needed of the TCS data to realize the functionality described herein. In some embodiments, the interpretation components 310 could be considered optional and need not be included.

The security components 310 anonymize data from the train control system 200 that could otherwise be exploited for malicious purposes. As such, train identification data and route identification data, for example, is removed from associated data streams when needed. In another case, anonymized data from the train control system 200 may be received from the train control system 200 instead of being produced in the security components. Regardless, any data output by the system 300 concerning train arrival or blocked crossing duration estimate therefore will relate to a generic train arrival event rather than to a specifically identified train along a specific route that is operated by a specific railroad operator. Also, the security components 312 may include decryption components for data and information sent to or received by the system 300, as well as to facilitate encrypted communications and the like for data sent from or retrieved from the system 300 as safeguards to protect data inputs and data outputs from access by unauthorized persons.

The crossing components 314 identify, based on train location data received from the train control system 200, railroad crossings in the track corridor ahead for which train ETA and blocked crossing duration estimates are desired. The crossing components operate specifically train-by-train that are traveling on the same or different corridors, and the crossings identified may cross the same or different railroad tracks in different segments of rail corridors or in different corridors entirely. The crossing components 314 may operate with respect to a database 326 including railroad routing and crossing information. By correlating train location information with such routing and crossing location information in the database 326, the system 300 can identify a plurality of crossings along the route for which train ETA and blocked crossing duration estimates may be desirably generated.

In contemplated embodiments, the identified railroad crossings may be geographically limited to crossings within a predetermined distance (e.g., 25-50 miles of the actual train location of each operation train). The predetermined distance may be extended for higher speed trains or reduced for lower speed trains. Depending on the specifics of the railroad corridors, the number of crossings identified may also be limited by the system 300 (e.g., estimates may be provided for the next 5 crossings) rather than being limited by distance-based limits. In other embodiments, identified crossings can be limited to those inside the boundaries of governmental entities such as towns, cities and municipalities as non-limiting examples. Other boundaries such as dispatch service boundaries, delivery service boundaries, etc. may also be used to limit the number of crossings for specific public or private concerns. Geofencing and other boundary setting techniques are possible that do not necessarily correspond to governmental interests or entities to limit the number of crossing considered by the system for particular end uses or end users. Outside of certain limits, train ETA and blocked crossing duration may become impractical for crossings that are too far removed from present train locations, but in some embodiments such limitations may be considered optional and need not be utilized.

The distance components 316 determine the distance between the train location data for each operating train and each of the crossings identified. Specifically, the distance components 316 operate on the Milepost data in the train location data in order to determine the track length distance between the Milepost location of the train and one or more crossings along the route that the train is moving toward. Milepost and routing information in the database 326 may be accessed to assess track distance Milepost-by-Milepost using converted Milepost to GPS data and actual track configuration data (e.g., straight versus curved track) to accurately account for railroad track modifications and optimization of rail corridors. In some embodiments, lookup tables may be generated and utilized by the system in determining distances. The distances are determined individually for each train to the respective crossings of interest, which may or may not have any independent ability to physically detect a train at the crossing.

The prediction components 318 determine the train ETA of each operating train at each of the identified crossings. The ETA determination may include dividing the distance value by the corresponding train speed data value for each of the identified crossings for the respective trains. Crossing-specific train ETA's are therefore generated for each train and each of the crossings approached. In some embodiments, lookup tables may be generated including train ETA values for train location, train speed and distance to crossing values, or ETA values for specific crossings based on train location and speed.

The prediction components 318 also determine crossing blockage duration values based on train speed and train length data and information from the train control system 200. For example, the blocked crossing duration is a function of train length divided by train speed. Lookup tables and the like can also be used to determine the blocked crossing duration estimate for a given train speed and length.

Consider, for example, a first train that is located 10 miles (52,800 feet) from a first crossing of interest, travelling at a speed of 45 mph (66 feet per second), and having a length of 6500 feet. The estimates may be determined as follows by the system 300. The train ETA is the distance divided by the train speed, or 52,800/66 or 800 seconds (13.3 minutes). The blocked crossing duration once the train arrives is the train length divided by the train speed or 6500/66 or about 98 seconds (1.63 min). Each of these estimates could be correlated with the time of the last train location report. As such, and following this example, if the train location was last reported at 12:00 pm the output of the system 300 may communicate a train ETA of 12:13 pm (12:00 plus 13 minutes for it to arrive at the crossing) and blocked crossing until 12:15 pm (train ETA of 12:13 plus blocked crossing duration of 1.63 minutes).

The reader may recognize from the above example that for a second crossing of interest located 20 miles away for the same train, the train ETA for the second crossing is about double the first, so the train ETA at the second crossing would be 12:26 pm with crossing blocked until 12:28 pm. This means that for motorists in route at 12:00 pm heading toward the same crossings, the system 300 may provide up to 13 minute and 26 minute lead times for drivers and/or vehicle systems to anticipate and avoid blockages at the respective first or second crossings.

Also consider a second a train located 15 miles (79200 feet) from a third crossing of interest travelling at a speed of 30 mph or 44 feet per second and having a length of 14000 feet. The estimates may be determined as follows by the system 300. The train ETA is the distance divided by the train speed, or 79200/44 or 1800 seconds (30 minutes). The blocked crossing duration once the train arrives is the train length divided by the train speed or 14000/44 or about 318 seconds (5.3 min). This could be correlated with the time of the last train location report. As such, and following this example, if the second location was last reported at 12:00 pm the output of the system 300 may communicate a train ETA of 12:30 pm (12:00 plus 30 minutes for it to arrive at the crossing) and blocked crossing until 12:36 pm (train ETA of 12:13 plus blocked crossing duration of 5.3 minutes).

The reader may recognize from the example above that for a fourth crossing of interest located 30 miles away for the same train would result in a train ETA for the fourth crossing that is about the double the estimate for the third crossing, so the train ETA at the fourth crossing would be 1:00 pm with crossing blocked until 1:06 pm. This means that the system 300 may provide up to 30 minute and 1 hour lead times for drivers and/or vehicle systems to anticipate and avoid the blocked crossing.

It should be realized that the system 300 simultaneously provides estimates such as those above for the first and second trains respectively moving toward the first, second, third and fourth crossings. By extension, the system simultaneously provides estimates for all operating trains and all identified crossings for the trains that are operating. This is contrasted with conventional train detection systems that physically sense train arrival only at crossings where trains are actually arriving with no prior knowledge of a train on approach. In other words, conventional train detection systems detect trains one at a time when actually present at specific crossings where the conventional train detection systems are installed, whereas the system 300, via the estimates generated, operates across multiple trains and multiple crossings (regardless of whether the multiple crossings including any train detection capabilities), enabling capabilities that conventional train detection systems simply cannot realize.

Train ETA and blocked crossing estimates may be provided by the system 300 with crossing-specific information with varying amounts of lead time for oncoming vehicles to each crossing, but with sufficient lead time for drivers and vehicle systems to change routes in order to avoid a traffic delay at one or more of the crossings. In contemplated systems, data and information from the train control system 200 is evaluated periodically (e.g., about every ten minutes) so a vehicle that is travelling along a route at a rate that places it about one hour away from a crossing may be given six opportunities in the ensuing hour to take actions to avoid the blocked crossing. As another example, when data and information from the train control system 200 is evaluated periodically (e.g., about every two minutes) a vehicle that is travelling along a route at a rate that places it about one hour away from a crossing may be given thirty opportunities in the ensuing hour to take actions to avoid the blocked crossing. Such action taken to avoid the blocked crossing may include altering the vehicle speed, changing the vehicle route, opportunistically refueling the car, or taking a break in a manner that avoids arriving at the crossing while the train is there to block the crossing. The driver may avoid idling at the railroad crossing waiting for the train to pass and any inconvenient delay in travel associated with the blocked crossing.

The periodic sampling and evaluation of the system 300 improves accuracy of the estimates provided. For example, if the train changes speed between sampling periods the new speed and location data captured at the next sampling interval will trigger a re-calculation of train ETA and blocked crossing duration. Monitored over the course of an hour, for example, the iterative data sampling and calculations that are refined about six times (or more) before the train actually reaches a given crossing will mean progressively more accurate estimates that account dynamically for changes in train speed over the last hour. As such, the system could determine but not report earlier estimates that may not be accurate in favor of reporting later determined estimates having a higher degree of accuracy. A sampling frequency of greater or less than 10 minutes is possible and may be utilized in other embodiments of the system.

Machine learning components 324 analyze estimates produced by the system 300 and improve ETA and blocked crossing duration estimates even further. For example, current estimates may be compared to prior estimates, and patterns may be deduced that may desirably lead to adjustments in the estimates generated at each iteration. For example, if the components 324 identify an over-estimation or under-estimation of a current estimate relative to prior estimate, an over-estimation or under-estimation of a prior estimate, or a pattern of over-estimation or underestimation that may occur for certain crossings, appropriate adjustments can be made to the current estimates to compensate as described above. As one example of this type of adjustment, calculated estimates or values in lookup tables may be adjusted up or down for certain crossings based on prior estimates for the same crossing. Such adjustment could further be informed by train sensing data from the systems 104*a*, 104*b*, 104*c*, 104*d* (FIG. 2) that may be compared to estimates generated and provide a further basis for machine learning to progressively determine more reliable estimates over time.

Archiving and reporting components 322 allow for diagnostics and troubleshooting of the system 300, and may be accessed by the machine learning components 324 for review and analysis. Human operators and overseers may also access the archiving and reporting components 322 for system oversight through the administrative interface 308.

The predictive railroad crossing system 300 also includes a communications interface 328 for outputting data to devices and systems such as those described below with significant benefits. Communications of data outputs may occur wired or wirelessly utilizing suitable communication protocols.

Enrollment components 330 are also optionally included in some embodiments. The enrollment components 330 allow for enrollment or registration of specific devices that the system 300 is to communicate with in specific formats or protocols pertinent to each specific device. Such specific devices, referred to herein as receiver devices may be identified in the enrollment components with supporting data to allow targeted messaging capability to each receiving device. As such, the system 300 is capable of selectively communicating with some connected devices but not others at any given point in time. As such, the applicable receiving device may receive output prediction information that specifically applies to such receiving devices, while other receiving devices operating in areas with no current train ETA estimates or blocked crossing estimates will not receive crossing status and estimate information. The system 300 is therefore beneficially able to communicate with selected receiving devices on a need to know basis to evaluate actions (e.g., alerts, suggested route changes, etc.) to avoid blocked crossings and improve crossing safety via advance notice of predicted train arrival.

In some contemplated embodiments, the enrollment components may also include authorized user information and authorized user device information for personal devices and the like. The enrollment may also include township, municipality, and city information to provide targeted services to crossings located in or overseen by specific entities, or to offer different levels or degrees of service to provide more or less sophistication of notification, alerts and suggestions for alternate routes and detours for specific entities, specific end application and specific users, for example. Boundary information such as that described above may be defined in the enrollment components for certain applications and certain users. Within boundaries, crossing-specific enrollment decisions may be made, wherein some crossings may be enrolled for the services of the system 300 while other crossing are not enrolled. Enrollment information may include contact information and billing or payment information in some cases. Whether paid or not, subscription type-services for only authorized users and authorized devices provides another safeguard against improper access and use of data outputs by the system, as well as improved record keeping regarding specific communications made by the system over time.

Figure 4:
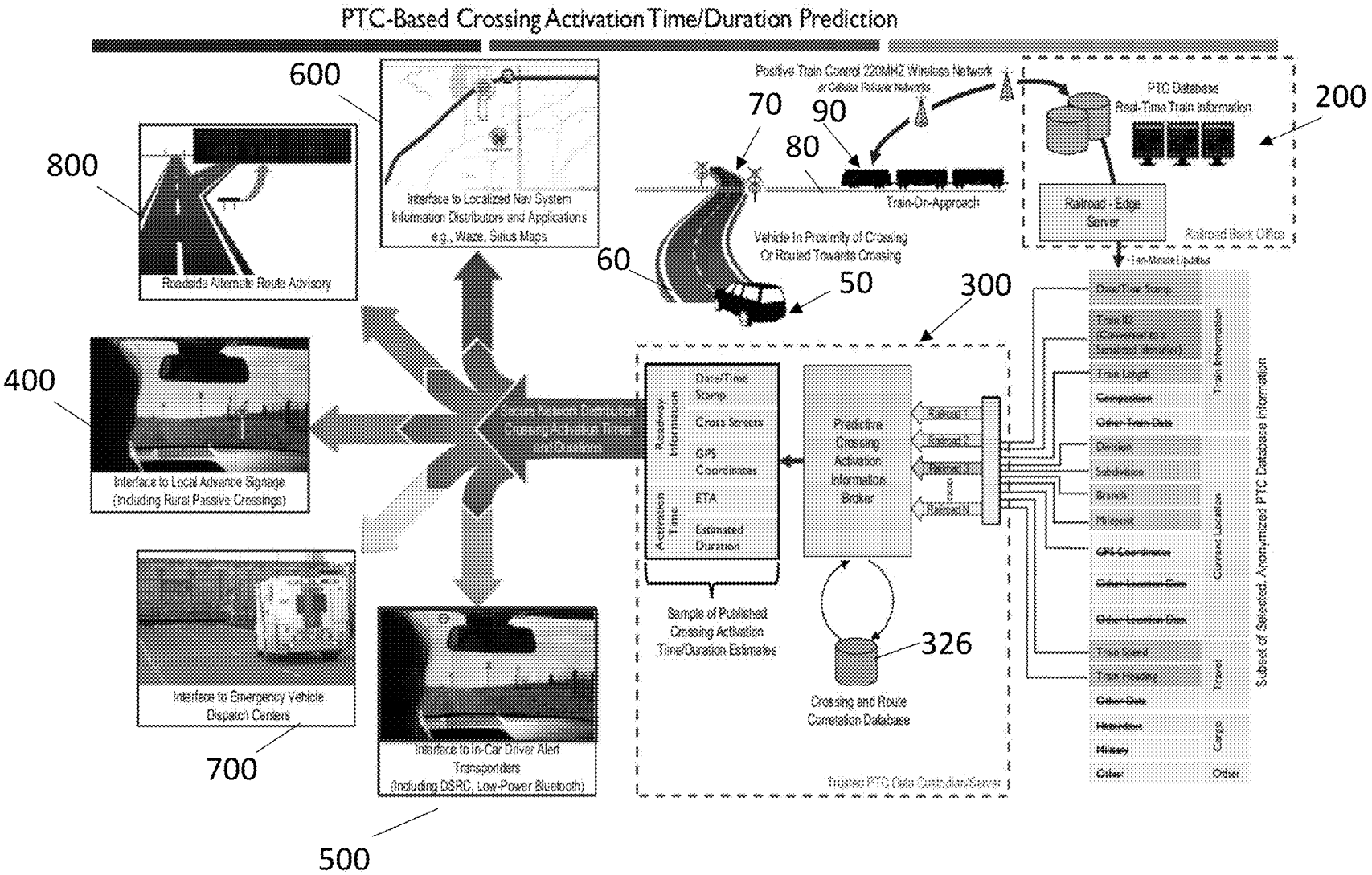
FIG. 4 schematically illustrates an operation of the predictive railroad crossing notification and traffic control systems shown in FIGS. 1-3.
Figure 5:
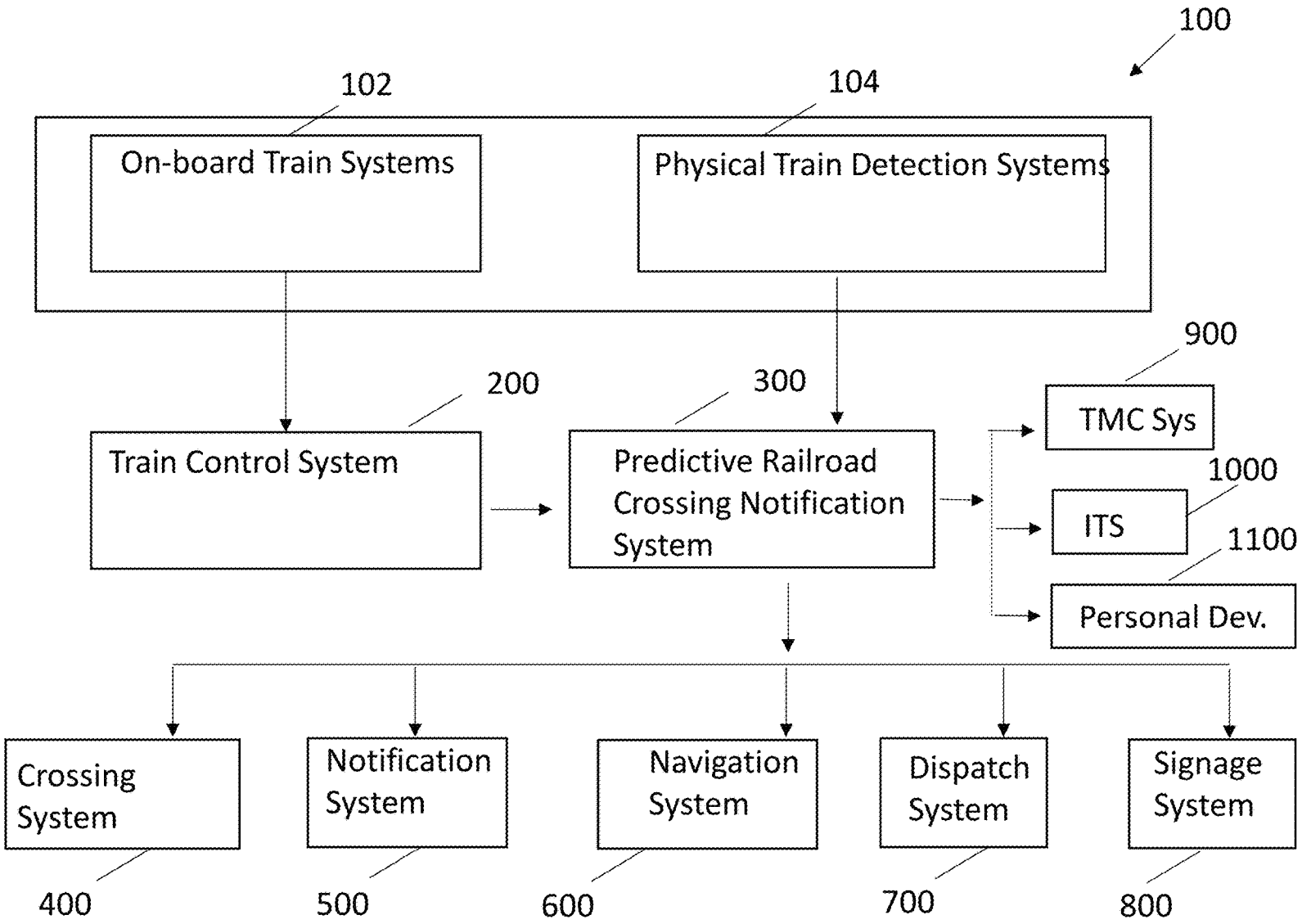
FIG. 5 is block diagram of the system shown in FIG. 4.

FIG. 4 schematically illustrates an operation of the predictive railroad crossing notification and traffic control system 100, which is also shown in block diagram form in FIG. 5.

As shown, a vehicle 50 is progressing on a roadway 60 toward a railroad crossing 70 where the roadway 60 crosses a set of railroad tracks 80 upon which a locomotive train 90 is progressing toward the crossing 70. The roadway 60 is only one of many roadways that include a railroad crossing 70 with railroad tracks 80 upon which numerous trains 90 can operate at any given time. Numerous trains 90 and numerous vehicles 50 can approach the various different crossings at different locations at about the same time.

In various different examples, the railroad crossing 70 may be public or private, may or may not include a physical train detection system, and may or may not include an active or passive warning system. The predictive estimates generated by the system 100 via the predictive railroad crossing notification system 300 are universally applicable to different types of crossings that are identifiable to the system. Because the system 300 does not require physical train detection at any individual crossing to generate train ETA and blocked crossing duration estimates, the system is capable of improving safety and traffic routing at crossings that are not presently equipped with railroad-operated or third party supplied train detection systems. For crossings that are presently supplied with railroad-operated or third party train detection systems and active crossing warning systems, additional functionality and improvements is made possible by the system as described herein.

The railroad tracks 80 in the example of FIG. 4 are PTC enabled tracks such that Positive Train Control system 200 operates with full awareness of operating status of the train 90. The onboard system 102 (FIG. 1) of the train locomotive reports train data to the PTC system 200 via, for example, 220 MHZ wireless network or cellular networks to rail edge servers and ultimately to a centralized PTC system 200 and database for storage.

In the illustrated example, the PTC system 200 operating at a predetermined frequency iteratively outputs data to the predictive railroad crossing notification system 300. The interval may be about every ten minutes to provide updated data and information regarding the operation of the train 90 as it progresses toward the crossing 70. In one contemplated embodiment, the data output from the PTC system is a subset of the data collected from the train 90, and as shown in FIG. 4 the output data includes a date/time stamp, train ID (converted to a serialized identifier), train length, train speed, train heading and location data reported by Division, Subdivision, Branch and Milepost. In the illustrated example, the PTC system 200 does not output the GPS coordinates of the train directly, but instead indirectly reports the location along the railroad corridor route by Division, Subdivision, Branch and Milepost.

The predictive railroad crossing notification system 300 receives the output data from the PTC system 200 as a trusted PTC data custodian. The predictive railroad crossing notification system 300 may receive data and data updates from multiple railroad operators concerning the respective trains operated by each railroad entity. The data outputs may be the same or different in format and content from systems operated by each railroad entity. The data outputs from the PTC system 200 are input to the predictive railroad crossing notification system 300, and the system 300 determines train ETA and blocked crossing duration estimates at the crossings that each train is moving toward. As described above, the estimate generation may involve consultation of the database 326 for crossing identification, route information, and Milepost conversion to determine the distances needed to make the desired estimates. While one database 326 is shown in FIG. 4, more than one database may be needed for complete access to crossing identification, route information, and Milepost conversion tasks. When the predictions are completed, the predictive railroad crossing notification system 300 outputs estimate information in the example shown in a twofold manner with roadway information and crossing information.

The roadway information data is output with date/time stamp, cross street data, and GPS coordinate data in one example. The crossing information is output in terms of crossing activation time with train ETA at an identified crossing and estimated duration of the blocked crossing by the train. The GPS coordinates in the roadway information may be the GPS coordinates of the crossing, serving the dual purpose of driver/vehicle notification of an arriving train well in advance of its actual arrival at each crossing, as well as providing notification and operating warning systems at the crossing itself. The data outputs from the predictive railroad crossing notification system 300 may be communicated wirelessly and may be received by numerous vehicle systems and numerous crossing locations at each update interval by the PTC system 200. In some cases, wired communication from the predictive railroad crossing notification system 300 to external devices may also be made. Any secure communication protocol may be utilized to communicate the output estimate information from the predictive railroad crossing notification system 300.

In the examples shown in FIGS. 4 and 5, the predictive railroad crossing notification system 300 proactively communicates train ETA and blocked crossing duration estimate data to crossing systems 400 operative at the location of each crossing, notification devices and systems 500 that are not at the crossing, vehicle navigation systems 600 that can intelligently inform motorists and assist with alternative route options to avoid a crossing if desired, vehicle dispatch systems 700 such as emergency vehicle dispatch centers, and vehicle route signage systems 800 located along the roadway at some distance from the crossings with active train ETA and blocked crossing duration estimate data for a train on approach. Each of the systems 400, 500, 600, 700 and 800 are further described below.

As shown in FIG. 5, still further estimate information data outputs are communicated from the predictive railroad crossing notification system 300, including but not necessarily limited to a Traffic Message Channel (TMC) system 900 that communicates traffic information via FM radio broadcasts for the benefit of motorists, an Intelligent Transportation System (ITS) system 1000, and to personal devices 1100 such as smartphones. Communications received through personal devices 1100 allows estimate information to be received apart from any vehicle operation when desired. While not shown in FIG. 5, train ETA and blocked crossing duration estimates could also be proactively communicated to Transportation Management Systems for commercial business operations to more effectively manage fleet vehicles and improve efficiencies.

Figure 6:
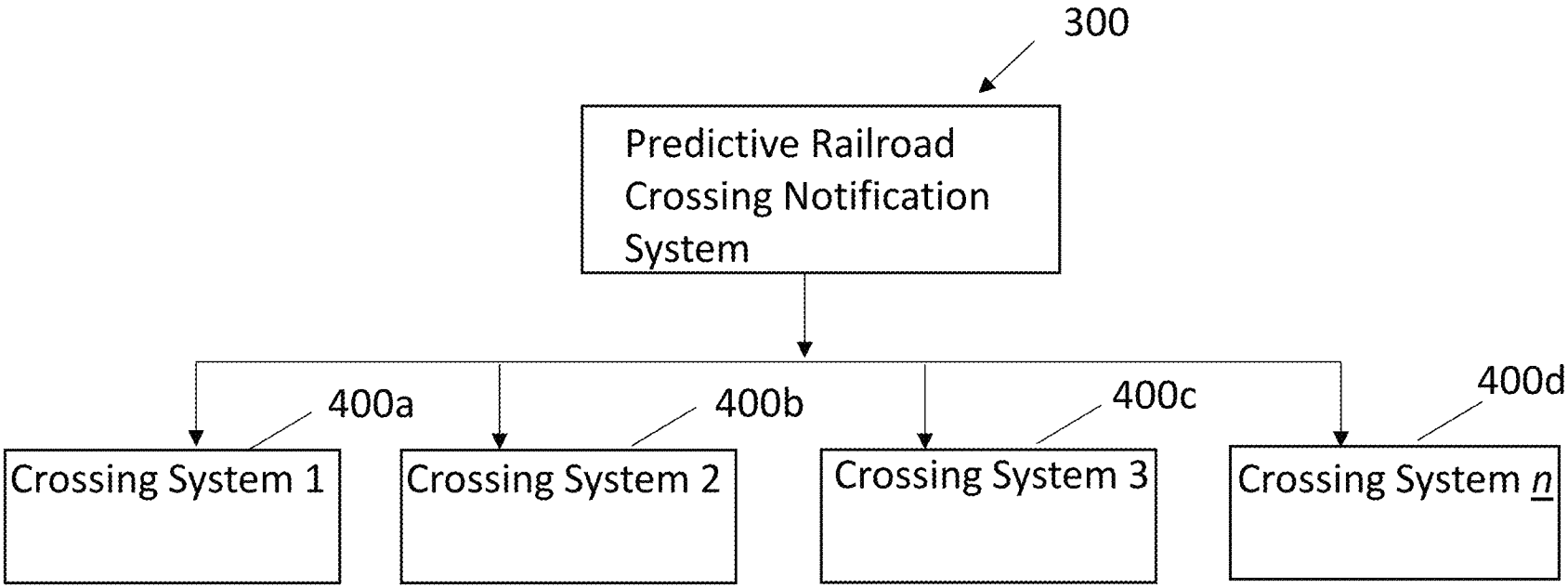
FIG. 6 is a block diagram of a first exemplary subsystem of the exemplary predictive railroad crossing notification and traffic control system shown in FIGS. 4 and 5.

FIG. 6 is a block diagram of a first exemplary subsystem of the exemplary predictive railroad crossing notification and traffic control system 100 making clear that the predictive railroad crossing notification system 300 is scalable to communicate with any number n of crossing systems 400*a*, 400*b*, 400*c*, and 400*d*. The crossing systems 400*a*, 400*b*, 400*c* and 400*d* are located at different locations along the same or different railroad corridors of the same or different railroad entity.

Figure 7:
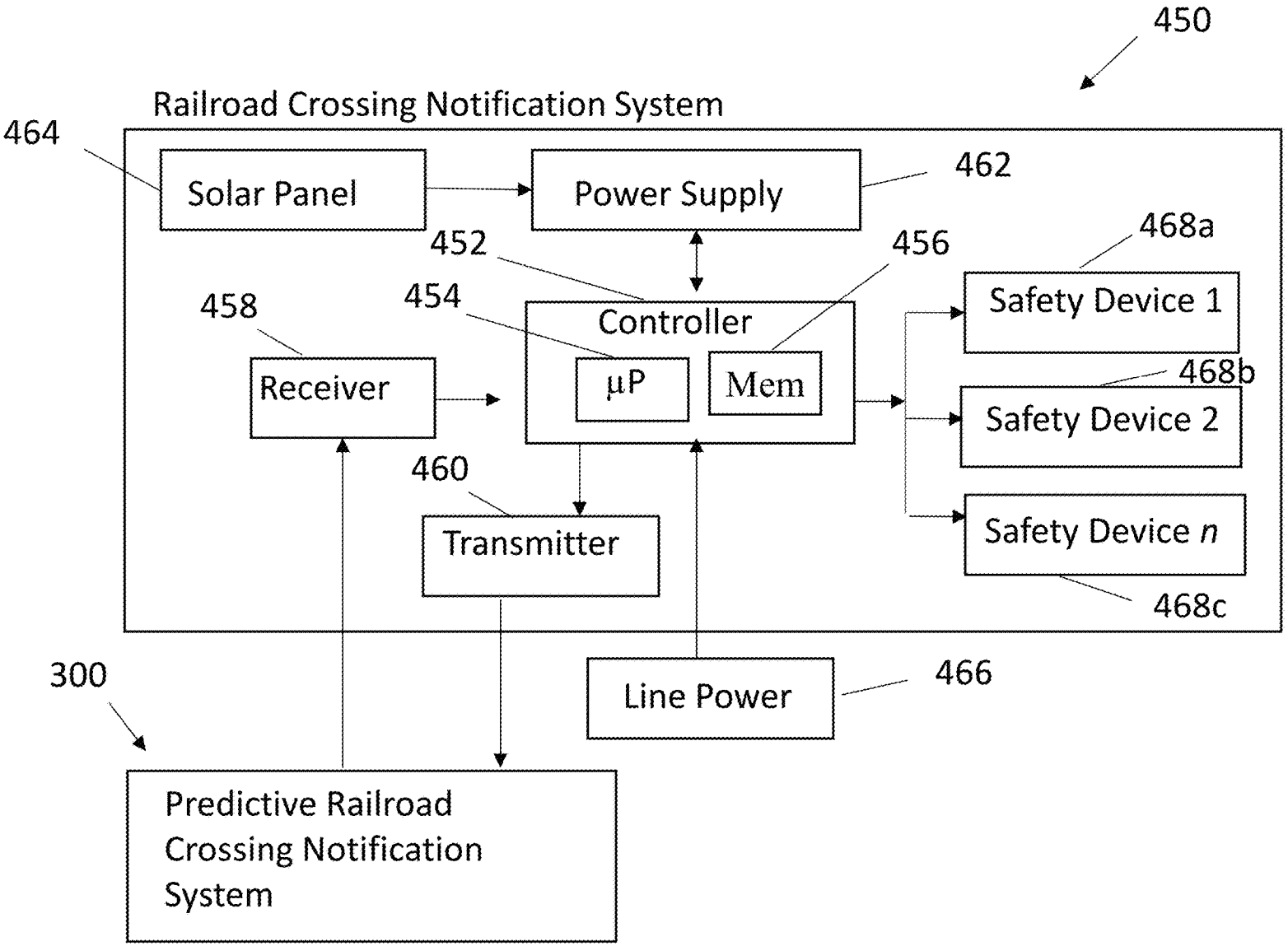
FIG. 7 is a block diagram of an exemplary railroad crossing notification system for the system shown in FIGS. 4-6.

An exemplary crossing notification system 450 is shown in FIG. 7 as one example of a crossing warning system 400 for the system 100. The system 450 includes a controller 452 having a microprocessor 454 and a memory 456. The system 450 further includes a receiver 458 and a transmitter 460 for receiving and sending wireless data and information signals from and to the predictive railroad crossing notification system 300. In some embodiments, the receiver 458 and transmitter 460 could effectively be combined into one element known as a transceiver. In another embodiment wherein hard wired communication is employed, the receiver 458 and transmitter 460 may be considered optional and need not be included, and other communication interfaces may be appropriately included in the system 450.

In one embodiment, the controller 452 and other elements in the system 450 are powered by an onboard power supply 462 such as a battery, which may in turn be renewably charged by one or more photovoltaic solar panels 464. As such, the system 450 can be beneficially installed and used at relatively low cost in remote, rural areas where hard wired electrical cabling does not exist. Additionally, the solar powered system could be easily installed at a low cost point in locations where hard wired cabling does exist. Alternatively, and as also shown in FIG. 7, the controller 452 may be connected to a line power supply 466 where such line supply exists at a crossing site, or is affordably provided.

The controller 452 is responsive to the data outputs of the predictive railroad crossing notification system 300 to operate safety devices 468*a*, 468*b*, 468*c* at the site of the crossing where the system 450 is installed when the generated crossing estimates apply to the crossing. The safety devices may include in different embodiments, static (i.e., constant) or dynamic (i.e., flashing) warning lights, audio alert devices, and/or the operation of barrier/gate devices. Functionality of existing crossing warning systems may be provided by systems 450 when desired at crossings that do not presently include a train detection system or active or passive warning system. The number of safety devices is scalable to communicate with any number n of the aforementioned safety devices or other safety devices appropriately employed to improve crossing safety. In some cases, more than one system 450 may be installed at the same crossing.

Figure 17:
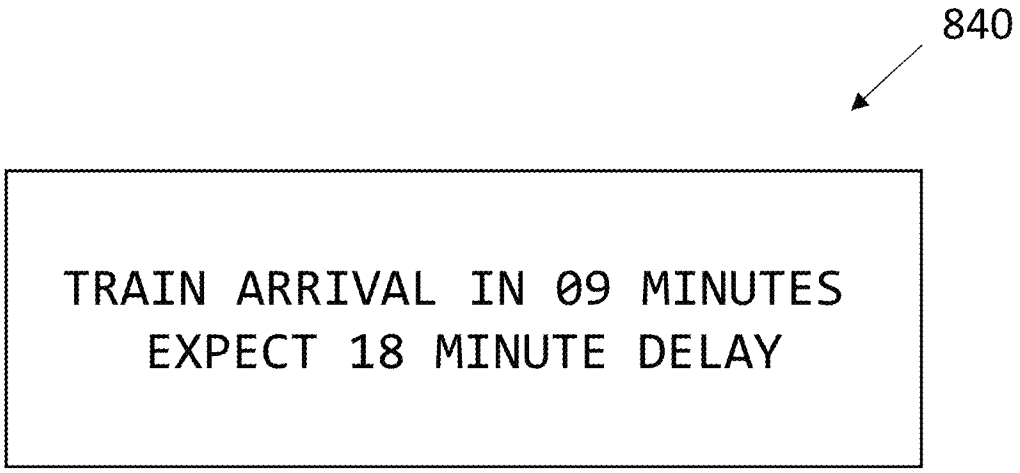
FIG. 17 illustrates an exemplary embodiment of electronic signage for the vehicle route signage system displaying a first crossing message.

In some embodiments, the safety devices 468 may include electronic signage notifying drivers of train ETA and blockage duration at the crossing site. For instance, the signage may display the message "TRAIN ARRIVAL IN 09 MINUTES" and "EXPECT 18 MINUTE DELAY" as illustrated in FIG. 17. Such signage could also be provided along a roadway in advance of the crossing site as further described below, perhaps with additional information identifying the crossing and optionally including a suggested detour. Drivers would therefore be afforded information that is not presently available to facilitate more optimal decisions. Drivers who wish to avoid an 18 minute delay in this example would have up to nine minutes to select an alternative route that would avoid traffic idling for an extended period of time. Of course, any motorist that chooses an alternative route would mean one less vehicle at the crossing site when the train actually arrives, and safety concerns would be reduced. Vehicles that are not present upon train arrival cannot collide with the train.

Figure 8:
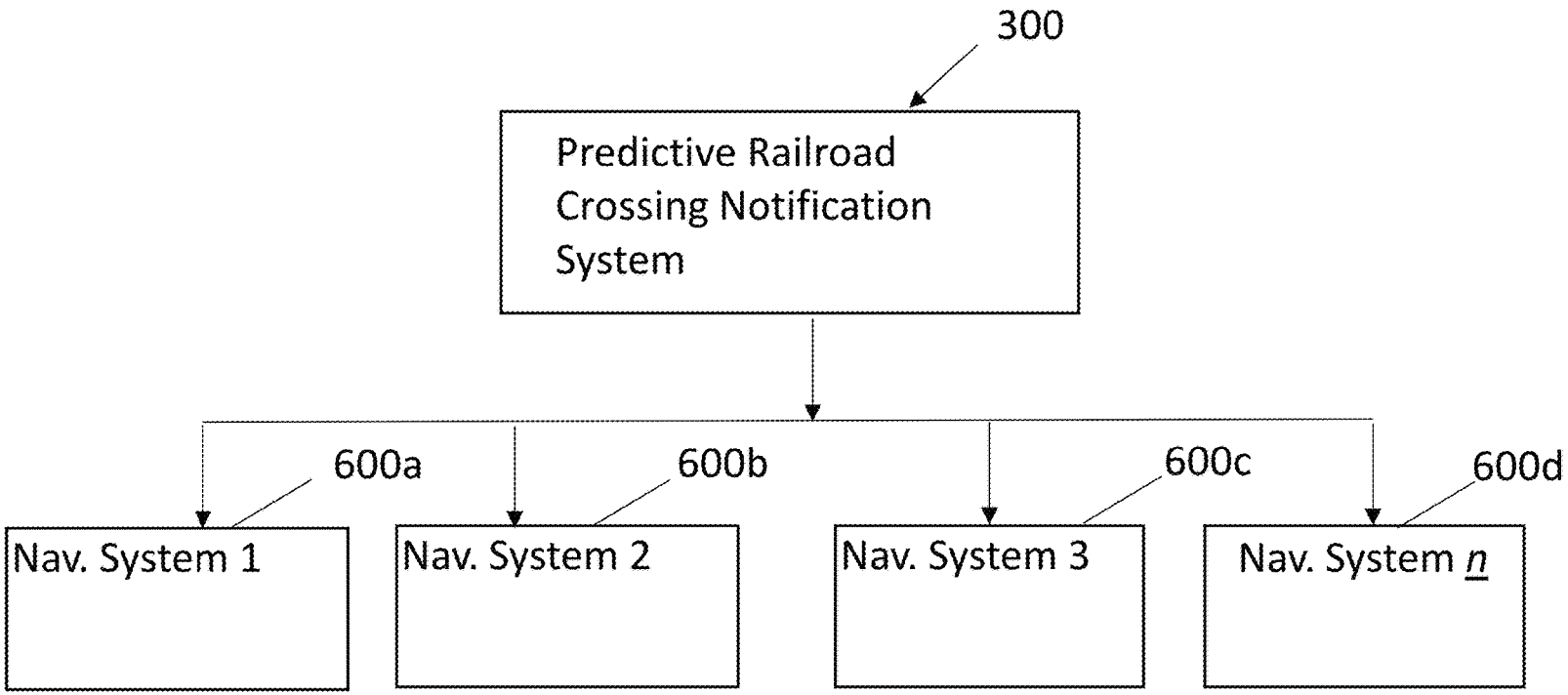
FIG. 8 is a block diagram of a second exemplary subsystem of the exemplary predictive railroad crossing notification and traffic control system shown in FIGS. 4 and 5.

FIG. 8 is a block diagram of a second exemplary subsystem of the exemplary predictive railroad crossing notification and traffic control system 100 making clear that the predictive railroad crossing notification system 300 is scalable to communicate with any number n of navigation systems 600*a*, 600*b*, 600*c*, and 600*d*. The navigation systems 600*a*, 600*b*, 600*c*, and 600*d* may be web-enabled systems connecting to vehicle systems or user devices such as smartphones, or built-in systems of vehicles accessible through OEM infotainment systems, or dedicated add-on navigational devices for vehicles that do not include OEM navigation systems. The predictive railroad crossing notification system 300 may communicate with the navigation systems 600*a*, 600*b*, 600*c*, and 600*d* in native formats for the respective systems to simplify actions to be taken by the navigation systems 600*a*, 600*b*, 600*c*, and 600*d* to avoid crossing delays when desired.

Figure 9:
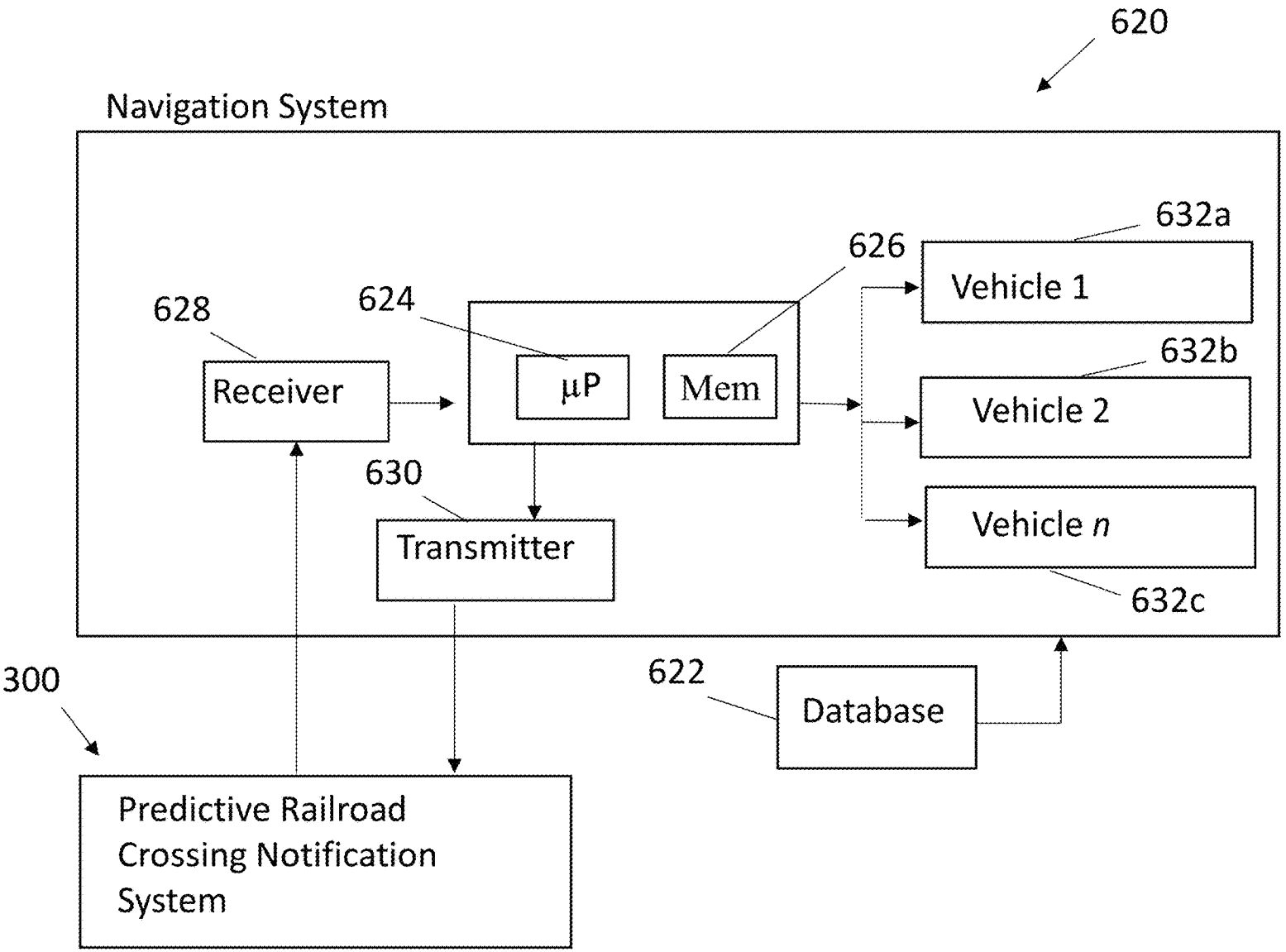
FIG. 9 is a block diagram of a first exemplary embodiment of a vehicle navigation system for the system shown in FIGS. 4, 5 and 8.

A first exemplary navigation system 620 is shown in FIG. 9 as a centralized navigation system 600 for the system 100. The system 620 includes one or more databases, a microprocessor 624 and a memory 626. The system 620 further includes a receiver 628 and a transmitter 630 for receiving and sending wireless data and information signals from and to the predictive railroad crossing notification system 300. In some embodiments, the receiver 628 and transmitter 630 could effectively be combined into one element known as a transceiver. In another embodiment wherein hard wired communication is employed, the receiver 628 and transmitter 630 may be considered optional and need not be included, and other communication interfaces may be appropriately included in the system 620.

The system 620 may be configured as a server-based localized navigation system information distributor application system. The system 620 is responsive to estimates generated by the predictive railroad crossing system to wirelessly communicate information to devices 632*a*, 632*b*, 632*c* or to provide the devices 632*a*, 632*b*, 632*c* access to the desired data. The devices 632*a*, 632*b*, 632*c* may be present in various different vehicles or to connected vehicles through devices such as smartphones. The system 620 is scalable to communicate with or provide service to any number n of devices 632.

In one contemplated example, the system 620 is a community-driven GPS navigation map which utilizes aggregated real-time data from the app's users to provide the best route to the user's destination. One popular system of this type corresponds to the popular Waze app available to iPhone and Android users. A system of this type beneficially may receive and send proactive train ETA and blocked crossing duration information to users who may respond with route changes that will be made available to other users on the system. As such, drivers may as a group avoid an 18 minute delay at a blocked crossing per the example above.

Alternatively the system 620 may be a data centric system operable on demand by system users of apps or subscription services. Apple Maps, Google maps and Sirius navigation systems are popular systems of this type. The system 620 of this type may be responsive to train ETA and blocked crossing duration information to users as routes are requested by users or may issue notifications to users in route. For example, if the above example of an 18 minute delay applies (or is about to apply) at a crossing along a possible route at the time that a route request is made, the system 620 could automatically suggest another route, or at least notify the user that a delay will be incurred for an available route option. As such, the user has opportunity before setting off to choose another route, delay start time, or take another action to avoid the lengthy delay.

Similar considerations apply to routes in progress. For example, a motorist may have been travelling for some time along a chosen route but may opt for a change when notified that an 18 minute delay may be incurred on the route ahead. Based on system preferences, the vehicle may be re-routed automatically by the system, the driver may be prompted for an alternative route selection, or the driver may be simply notified without the system providing an alternative route option.

Figure 10:
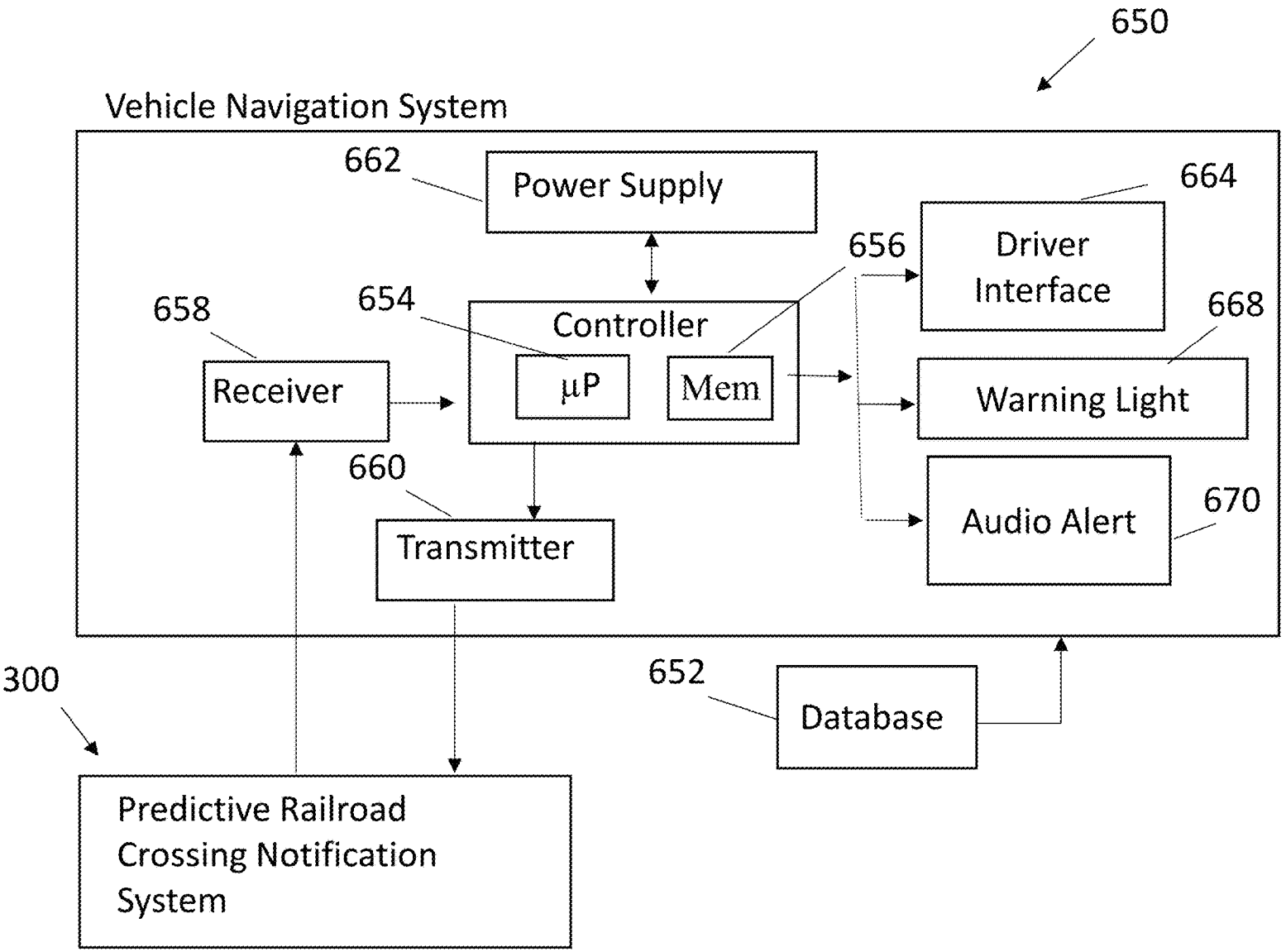
FIG. 10 is a block diagram of a second exemplary embodiment of a vehicle navigation system for the system shown in FIGS. 4, 5 and 8.

A second exemplary navigation system is shown in FIG. 10 as a vehicle-based navigation system 650 for the system 100. The system 650 is an onboard vehicle system including a database 652 with route information, a microprocessor 654 and a memory 656. The system 650 further includes a receiver 658 and a transmitter 660 for receiving and sending wireless data and information signals from and to the predictive railroad crossing notification system 300. In some embodiments, the receiver 658 and transmitter 660 could effectively be combined into one element known as a transceiver.

The system 650 may be configured as OEM equipment that is built-in to the vehicle system, or as an aftermarket, add-on system to provide navigational functionality for the vehicle. As such, in the case of OEM equipment the system 650 may be powered by the vehicle power system power supply battery 662. In the case of an aftermarket system, the system could have a separate power supply such as a rechargeable battery power supply 662 that is connectable to the vehicle power system when needed.

The system 650 is responsive to estimates generated by the predictive railroad crossing system to wirelessly communicate information to a driver interface 664 such as any number of known infotainment device display screens and input selectors or separately supplied, dashboard or windshield mounted display screens. One or more warning lights 668 may also be activated in the vehicle to garner the attention of a driver, and one or more audio alert devices 670 may be activated. Based on train ETA and blocked crossing estimates the system 650 may automatically redirect the driver to another route, prompt the driver to elect an alternative route, or simply inform the driver for use in making a personal choice how the driver would like to proceed. As such, the driver may take action to avoid the 18 minute delay at a blocked crossing per the example above.

On certain trips, the systems 620 and 650 may operate more than once to provide opportunity for a driver to avoid delays at more than one railroad crossing. Significant reduction in driving time may result by avoiding stalled traffic at crossings for lengthy period of time, as well as a more pleasant commute for drivers. Additionally, the estimates provided by the predictive railroad crossing notification system can in some cases be activated even when the navigation system is otherwise not being used. That is, the estimates can be applied for crossings in the immediate area to inform drivers who may or may not intend to proceed along the crossing.

Figure 11:
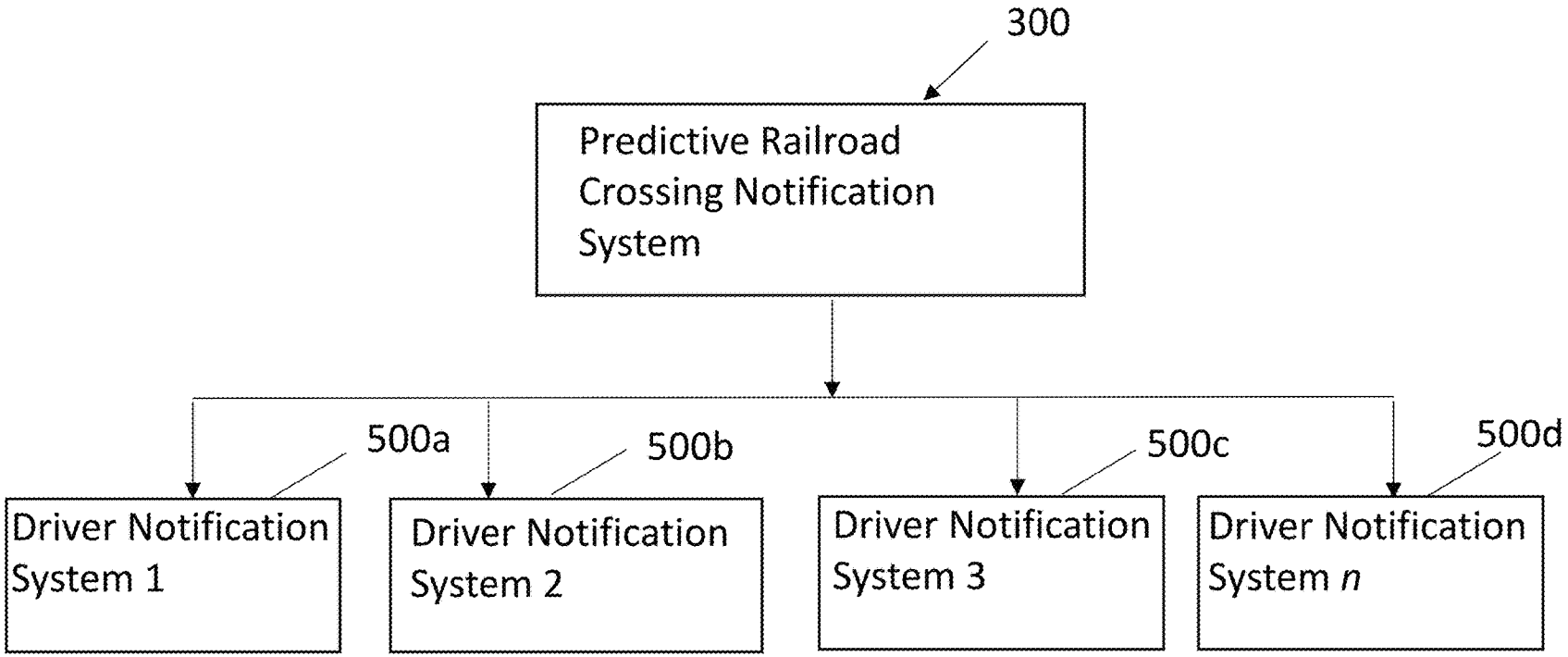
FIG. 11 is a block diagram of a third exemplary subsystem of the exemplary predictive railroad crossing notification and traffic control system shown in FIGS. 4 and 5.

FIG. 11 is a block diagram of a third exemplary subsystem of the exemplary predictive railroad crossing notification and traffic control system 100 making clear that the predictive railroad crossing notification system 300 is scalable to communicate with any number n of driver notification systems 500*a*, 500*b*, 500*c*, and 500*d*.

Figure 12:
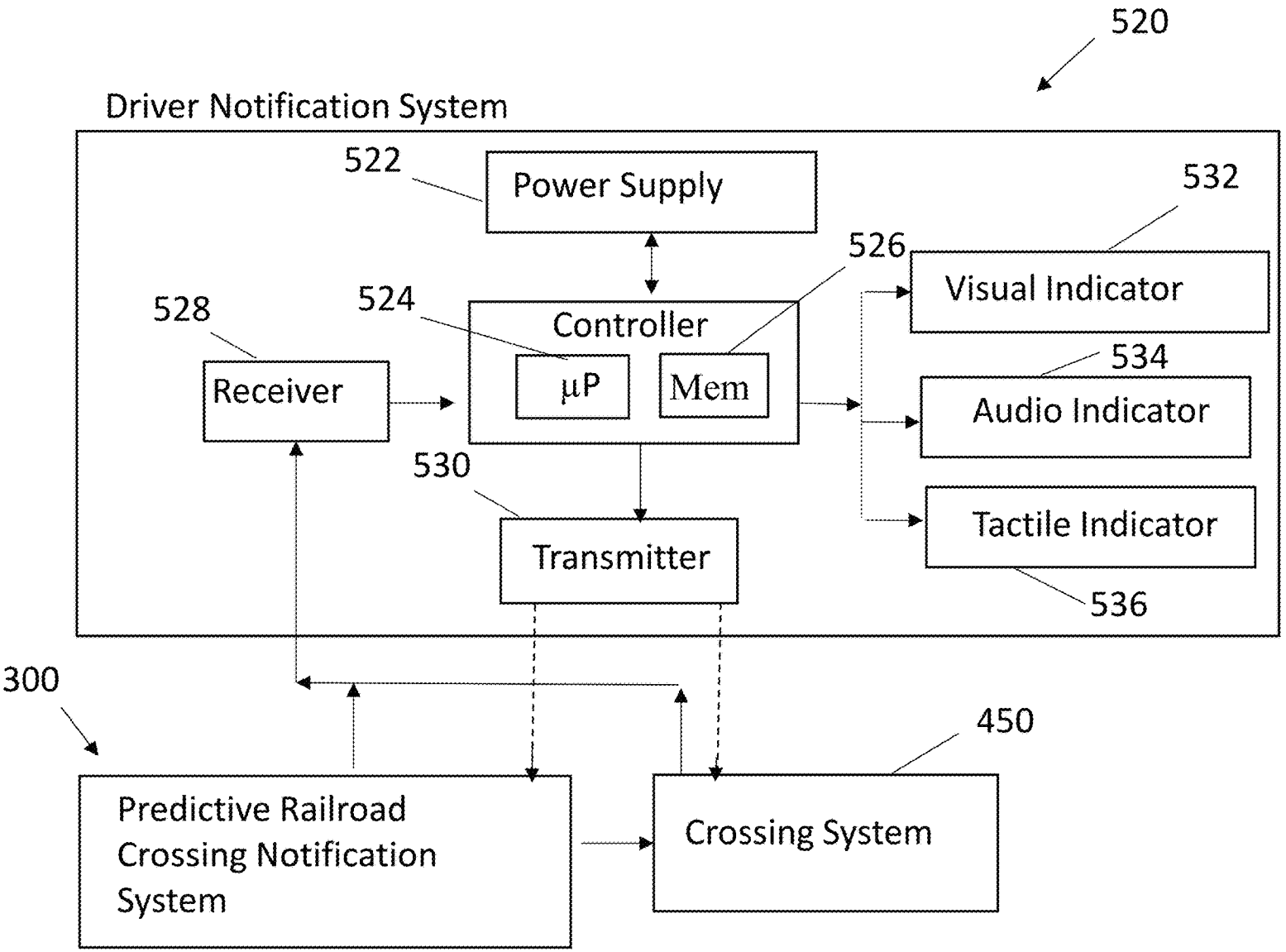
FIG. 12 is a block diagram of a first exemplary embodiment of a driver notification system for the system shown in FIGS. 4, 5 and 11.

A first example of a driver notification system 520 is shown in FIG. 12 that may be advantageously used in the system 100. The system 520 includes onboard power supply 524 such as a battery, a microprocessor 524 and a memory 526. The system 520 further includes a receiver 528 and a transmitter 530 for receiving and sending wireless data and information signals from and to the predictive railroad crossing notification system 300. In some embodiments, the receiver 528 and transmitter 530 could effectively be combined into one element known as a transceiver.

The controller including the microprocessor 524 is responsive to the data outputs of the predictive railroad crossing notification system 300 or to a communication from a crossing system 450 that has been supplied the data outputs of the predictive railroad crossing notification system 330. In response to the data outputs received, the controller operates one or more notification devices in the form of a visual indicator 532, an audio indicator 534, or a tactile indicator 536 in the example shown.

In one embodiment the system 520 is configured as a dedicated receiver device that can be located in a vehicle to receive crossing proximity alerts when the receiver device comes within a predetermined range of the crossing system 450 that broadcasts signals to the receiver device. When the receiver device in the vehicle is within signal range of the crossing system, the receiver device actives the visual indicator 532 (e.g., a warning light) as visual warning, the audio indicator 534 (e.g., chime, beep or voice message), and/or the tactile device 536 (e.g., a vibrating element) to call the driver's attention to a crossing ahead based on the applicable predictive train ETA and blocked crossing duration estimate for the roadway ahead.

As such, the system 520 effectively provides a special purpose, active warning system inside a vehicle as crossings are approached at times coincident with an arriving train. The system 520 may, for example, be mounted on a vehicle dashboard or windshield, or integrated into a rearview mirror assembly in various non-limiting examples. The system may include display features (e.g., a display screen or heads up projection on the windshield in front of the driver) to present graphical information such as railroad crossing systems and messages to a driver including train ETA and blocked crossing estimate information for a crossing that the vehicle is approaching. In other cases, the system 520 may be implemented as a relatively low cost, simple transponder device that operates on short range radio communications or other lower power communication protocols such as Bluetooth to provide basic driver notifications in a low cost manner.

The disclosure of U.S. Pat. No. 9,193,367 of Island Radar, hereby incorporated by reference in its entirety, teaches a crossing proximity and train-on-approach notification system using low power, short range radio communication which may benefit from the predictive estimates of the present invention and may therefore be combined with or incorporated by the system 100 in further embodiments. The system of U.S. Pat. No. 9,193,367 teaches train communication with crossing devices and train detection systems at the crossing to trigger train-on-approach notifications that could be compared with train ETA estimates and blocked crossing duration estimates to assess accuracy of the predictive estimates and intelligently adjust estimates over time based on such additional data points.

Devices 520 may also be carried by persons apart from a vehicle to receive predictive train ETA estimates and blocked crossing duration estimates. That is, the devices 520 could be used to actively warn persons who are not operating a vehicle or a train in the area. As non-limiting examples, such estimate information provided by the system of the invention would be advantageously known and utilized by railroad workers performing tasks at crossing sites, certain pedestrians who need to cross railroad tracks to and from destinations, and persons enjoying recreational activities such as biking or hiking in areas including railroad corridors. Decision making to ensure safety and avoid inconvenience by such persons is made possible via advance notice and additional lead time that the predictive estimates of train activity provide.

In another embodiment the system 520 is configured as a multipurpose device that can be used with and without a vehicle to receive person crossing proximity alerts when the receiver device comes within a predetermined range of the crossing system 450 that broadcasts signals to the receiver device. For example, the system 520 may be configured as a smartphone device running an app that selectively communicates with crossing systems 450 that are in signal range.

Instill another embodiment, the system 520 may be configured as a smartphone device running an app that selectively communicates with the predictive railroad crossing notification system 300 to receive updated estimate information from the system 300 over time. The smartphone owner could use the app while driving, biking, walking, working at a crossing site, or in other activity wherein advanced knowledge of train activity would be beneficial for safety reasons and to avoid disruptions in travel plans.

Figure 13:
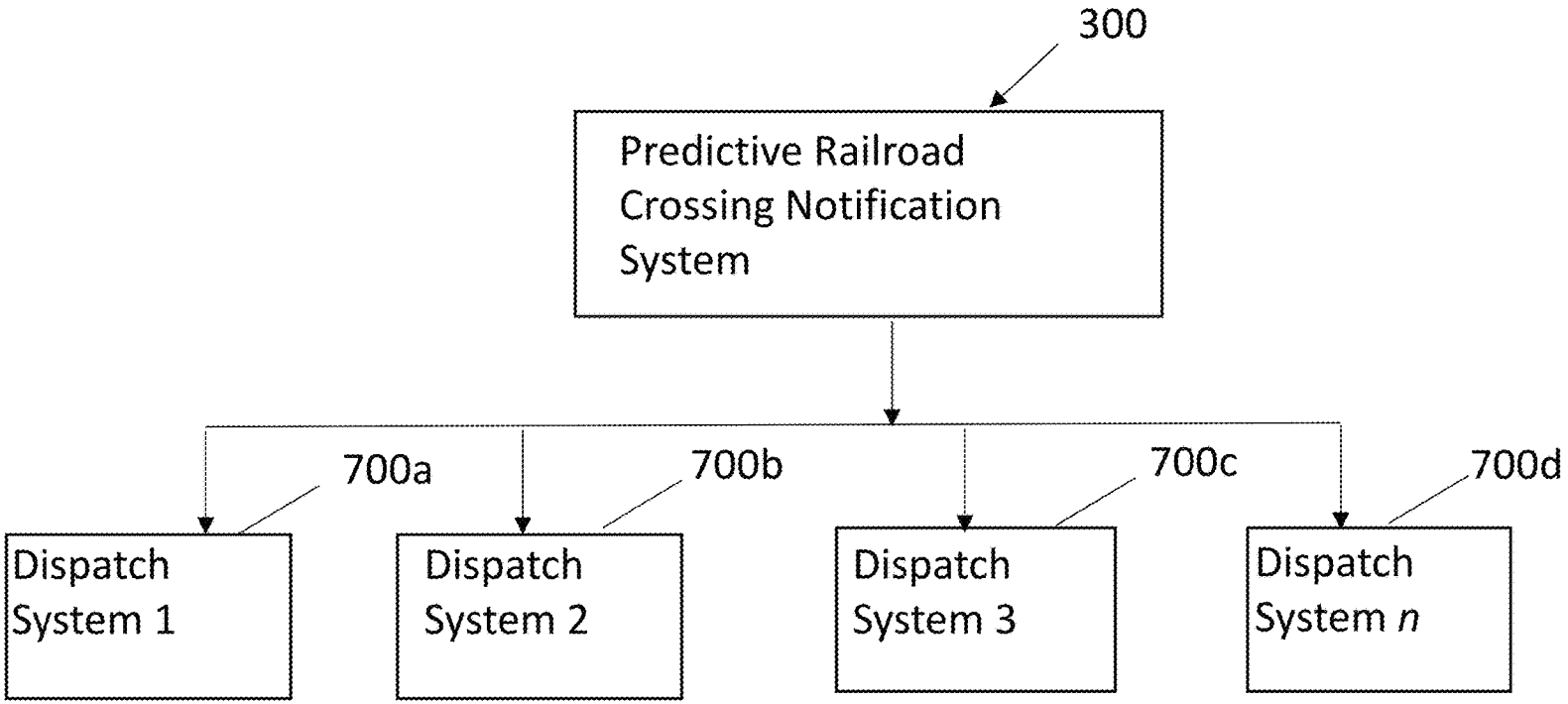
FIG. 13 is a block diagram of a fourth exemplary subsystem of the exemplary predictive railroad crossing notification and traffic control system shown in FIGS. 4 and 5.

FIG. 13 is a block diagram of a fourth exemplary subsystem of the exemplary predictive railroad crossing notification and traffic control system 100 making clear that the predictive railroad crossing notification system 300 is scalable to communicate with any number n of vehicle dispatch systems 700*a*, 700*b*, 700*c*, and 700*d*.

Figure 14:
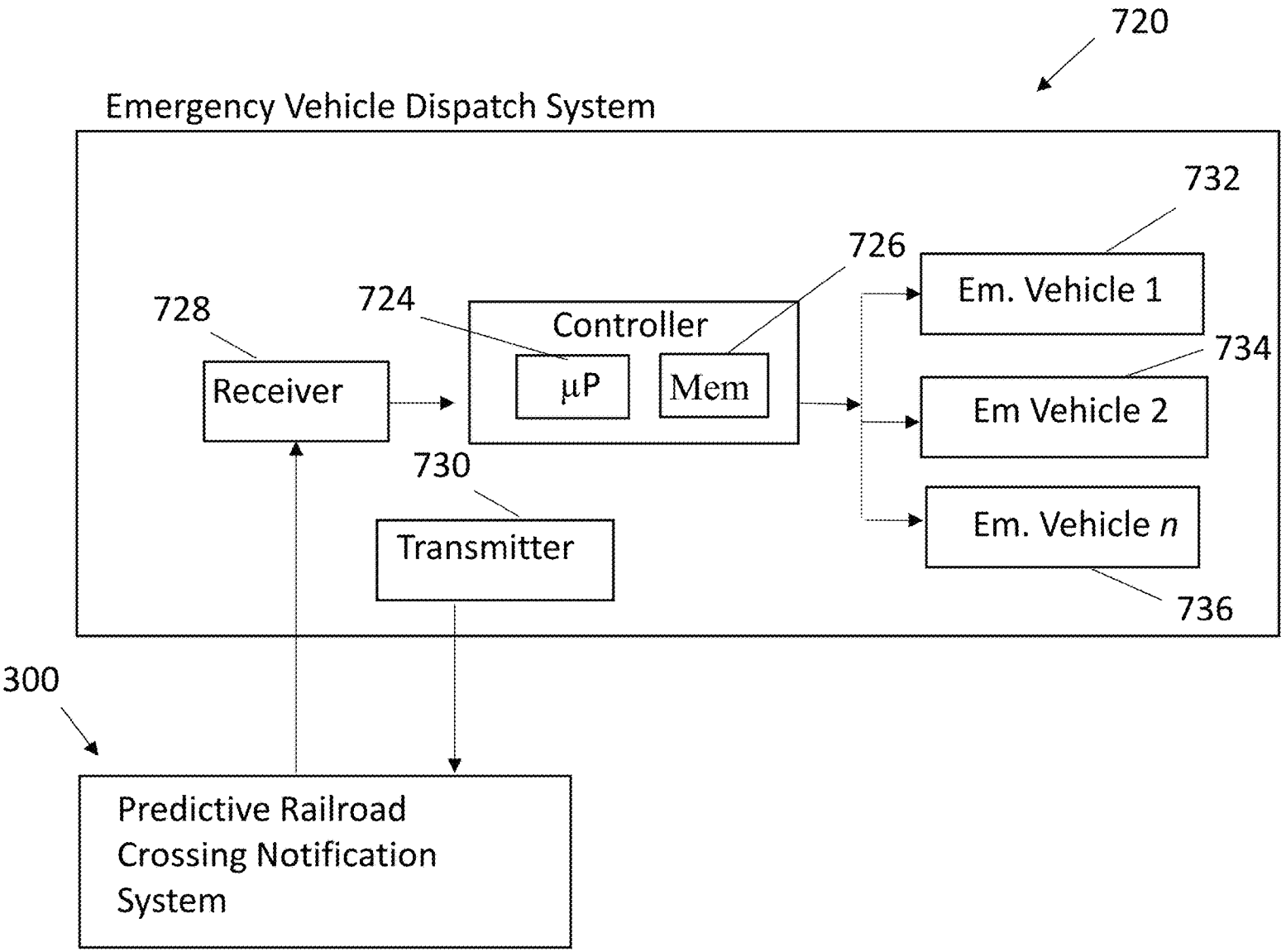
FIG. 14 is a block diagram of an exemplary embodiment of a vehicle dispatch system for the system shown in FIGS. 4, 5 and 13.

A first example of a vehicle dispatch system 720 is shown in FIG. 14 that may be advantageously used in the system 100. The system 720 includes a microprocessor 724 and a memory 726. The system 720 further includes a receiver 728 and a transmitter 730 for receiving and sending wireless data and information signals from and to the predictive railroad crossing notification system 300. In some embodiments, the receiver 728 and transmitter 730 could effectively be combined into one element known as a transceiver. In another embodiment wherein hard wired communication is employed, the receiver 728 and transmitter 730 may be considered optional and need not be included, and other communication interfaces may be appropriately included in the system 720.

The controller including the microprocessor 724 is responsive to the data outputs of the predictive railroad crossing notification system 300 to notify and/or re-route emergency vehicles 732, 734, 736 in view of the predictive estimate information generated that may negatively impact response time of the emergency vehicles 732, 734, 736 to arrive at respective locations of emergencies to assist and respond. The emergency vehicles may include, without limitation, police vehicles (cars, trucks and motorcycles), ambulances, firetrucks and other vehicles, including personal vehicles of emergency response personnel. Notifications generated by the system 720 may include suggested alternative routes, and may be automatically generated or manually provided by human dispatchers.

The system 720 may serve other vehicles besides emergency vehicles in some desired applications. For example, commercial fleet vehicles and delivery vehicles may realize significant efficiency increases by avoiding crossing-related traffic disruptions when possible. Passenger transportation vehicles such as buses, vans, shuttle vehicles, and taxis may likewise reap significant benefit from proactively ability to select optimal routes or change routes to avoid crossing-related travel delays. Drivers or ridesharing services (e.g., Uber and Lyft) may also be beneficially notified by a system similar to the system 720 in a centralized manner.

Figure 15:
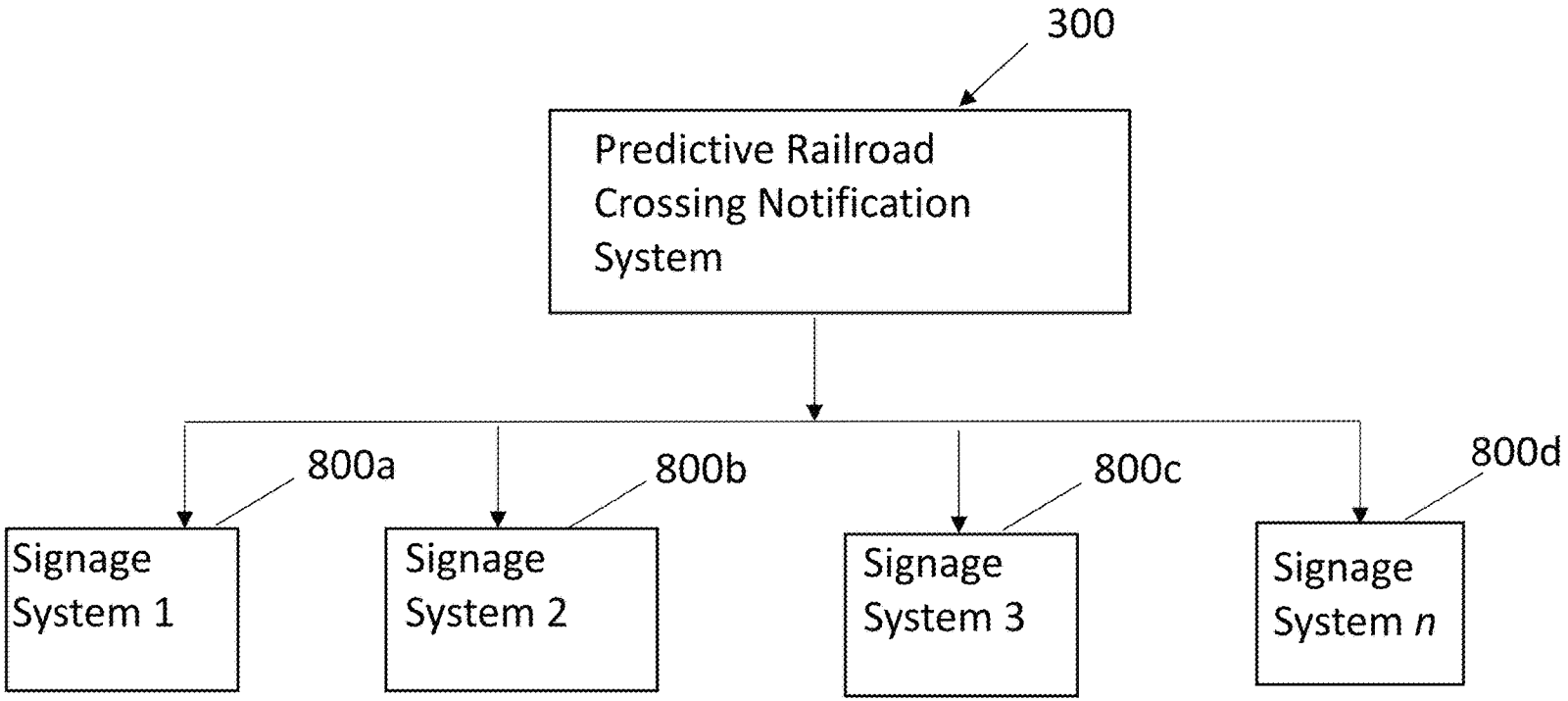
FIG. 15 is a block diagram of a fifth exemplary subsystem of the exemplary predictive railroad crossing notification and traffic control system shown in FIGS. 4 and 5.

FIG. 15 is a block diagram of a fifth exemplary subsystem of the exemplary predictive railroad crossing notification and traffic control system 100 making clear that the predictive railroad crossing notification system 300 is scalable to communicate with any number n of vehicle route signage systems 800*a*, 800*b*, 800*c*, and 800*d*.

Figure 16:
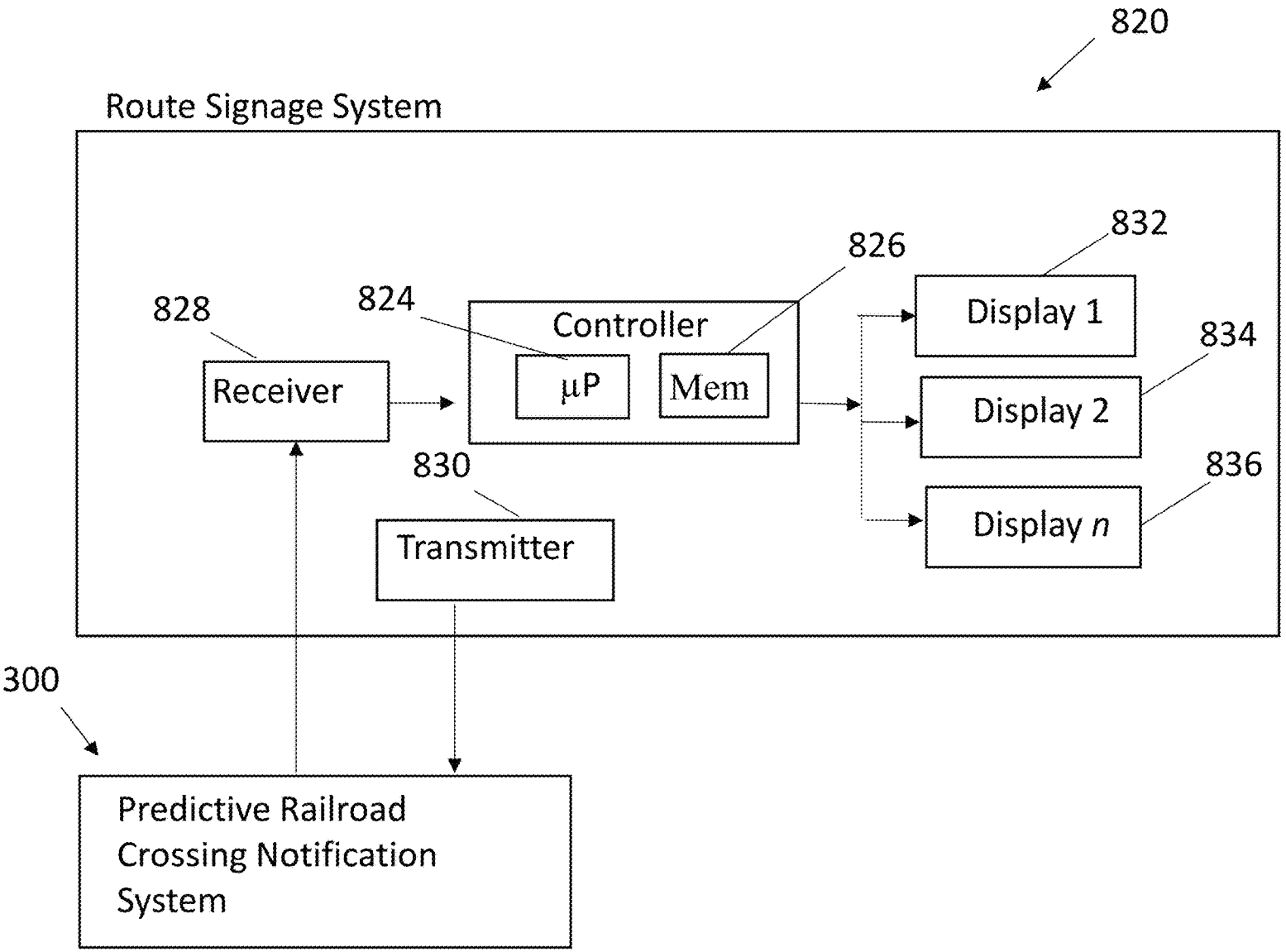
FIG. 16 is a block diagram of an exemplary embodiment of a vehicle route signage system for the system shown in FIGS. 4, 5 and 15.

A first example of a vehicle route signage system 820 is shown in FIG. 16 that may be advantageously included in the system 100. The system 820 includes a microprocessor 824 and a memory 826. The system 820 further includes a receiver 828 and a transmitter 830 for receiving and sending wireless data and information signals from and to the predictive railroad crossing notification system 300. In some embodiments, the receiver 828 and transmitter 830 could effectively be combined into one element known as a transceiver. In another embodiment wherein hard wired communication is employed, the receiver 828 and transmitter 830 may be considered optional and need not be included, and other communication interfaces may be appropriately included in the system 820.

The controller including the microprocessor 824 is responsive to the data outputs of the predictive railroad crossing notification system 300 to message route status information to one or more electronic signage including displays 832, 834, 836 in view of the predictive estimate information generated for crossings that vehicles are approaching. The displays may be located at the same or different site on a side of the roadway for observation by drivers. The displays present generated alphanumeric messages to motorists concerning the train ETA and blocked crossing duration estimates. Exemplary electronic signage displays are illustrated in FIGS. 17-21 notifying drivers of train ETA and blockage duration at various different locations.

The exemplary signage display 840 may show the message "TRAIN ARRIVAL IN 09 MINUTES" and "EXPECT 18 MINUTE DELAY" as illustrated in FIG. 17. In contemplated embodiments, this signage display would be appropriately displayed at the applicable crossing site. The message may be displayed in its entirety or in portions that switch back and forth from one to the other. For example, the signage may alternately display portions of the message in sequence such as the signage displaying only "TRAIN ARRIVAL IN 09 MINUTES" followed by only "EXPECT 18 MINUTE DELAY" and back again. Such signage may be utilized at a crossing that does not include one of the crossing systems 400, 450 providing active warning features for the crossing (e.g., lights, sounds and gates) to alert motorists. Likewise, such signage could be utilized at crossings with existing active or passive warning systems of the railroad or a third party to provide additional notification functionality including predicted crossing status information (train arrival information or train ETA) and blocked crossing duration estimate (expected delay) that does not presently exist from the perspective of motorists. The signage display 840 would dynamically count down the arrive time for motorists passing by at different times. For example, one minute later from the example above, the signage display 840 may show the message "TRAIN ARRIVAL IN 08 MINUTES" and "EXPECT 18 MINUTE DELAY".

At the expiration of the ETA period, the signage display 840 can switch to message "TRAIN AT CROSSING, EXPECT 18 MINUTE DELAY" and then dynamically count down the expected delay for motorists until the expected delay time has expired. The signage display 840 can then turn off until subsequent predictive estimate information is received. Optionally, the signage display 840 can message "CROSSING CLEAR" as an indication that neither a train nor delay is expected at the crossing.

Figure 18:
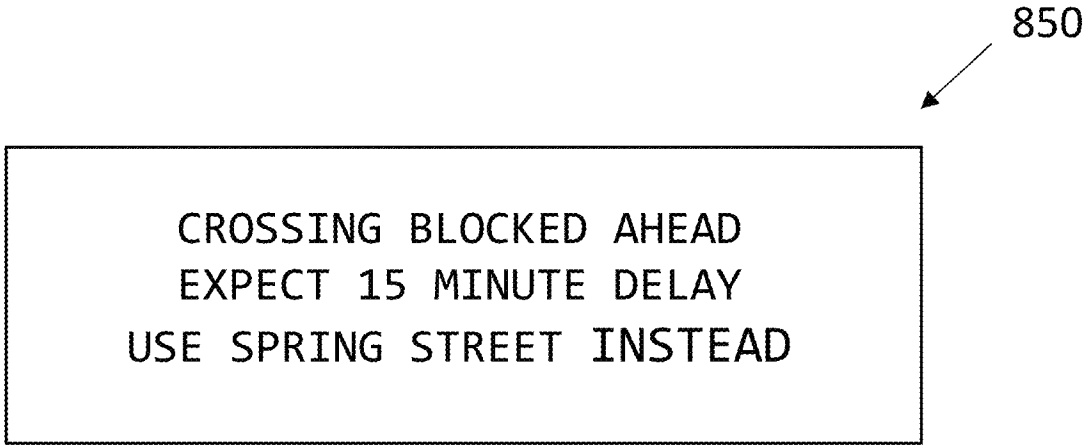
FIG. 18 illustrates an exemplary embodiment of electronic signage for the vehicle route signage system displaying a second crossing message.

The exemplary signage display 850 may show the message "CROSSING BLOCKED AHEAD", "EXPECT 15 MINUTE DELAY" and "USE SPRING STREET INSTEAD" as illustrated in FIG. 18. In contemplated embodiments, this signage display would be appropriately displayed at some distance from the crossing site that is the subject of the message. For example, in the case of a municipality, the signage 860 may be located 0.5 mi from the crossing, with Spring St. traversing the roadway between the signage and the crossing. The message may be displayed in its entirety or in smaller portions that switch from one portion to the other in sequence. Such signage provides additional notification functionality including crossing status information (blocked crossing), blocked crossing duration estimate (expected delay) and a suggested alternative route option (e.g., Spring St.) that does not presently exist from the perspective of motorists. The signage display 850 would dynamically count down the arrive time for motorists passing by at different times. For example, one minute later from the example above, the signage display 850 may show the message "CROSSING BLOCKED AHEAD", "EXPECT 14 MINUTE DELAY" and "USE SPRING STREET INSTEAD". Additional signage (static or dynamic) may be provided on Spring Street with additional detour route information.

At the expiration of the crossing delay period, the signage display 850 can then turn off until subsequent predictive estimate information is received. Optionally, the signage display 850 can message "CROSSING AHEAD CLEAR" as an indication that neither a train nor delay is expected at the crossing.

Figure 19:
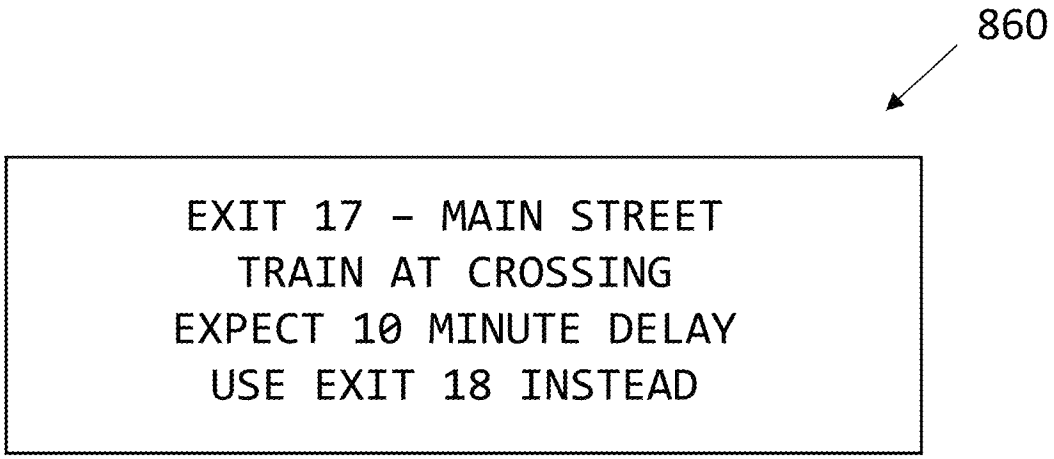
FIG. 19 illustrates an exemplary embodiment of electronic signage for the vehicle route signage system displaying a third crossing message.

The exemplary signage display 860 may show the message "EXIT 17—MAIN STREET", "TRAIN AT CROSSING", "EXPECT 10 MINUTE DELAY", "USE EXIT 18 INSTEAD" as illustrated in FIG. 19. In contemplated embodiments, this signage display would be appropriately displayed alongside a highway. The message may be displayed in its entirety or in smaller portions that switch from one portion to the other in sequence. Such signage provides additional notification functionality including route information (Exit 17—Main Street) accessible from the highway which includes a crossing, the crossing status (e.g., blocked by the train at the crossing), blocked crossing duration estimate (expected delay) and a suggested alternative route option (e.g., Exit 18) that does not presently exist from the perspective of motorists. The signage display 860 would dynamically count down the delay time for motorists passing by at different times. For example, one minute later from the example above, the signage display 860 may show the message "EXIT 17—MAIN STREET", "TRAIN AT CROSSING", "EXPECT 09 MINUTE DELAY", "USE EXIT 18 INSTEAD". Additional signage (static or dynamic) may be provided at Exit 18 with additional detour route information.

Figure 20:
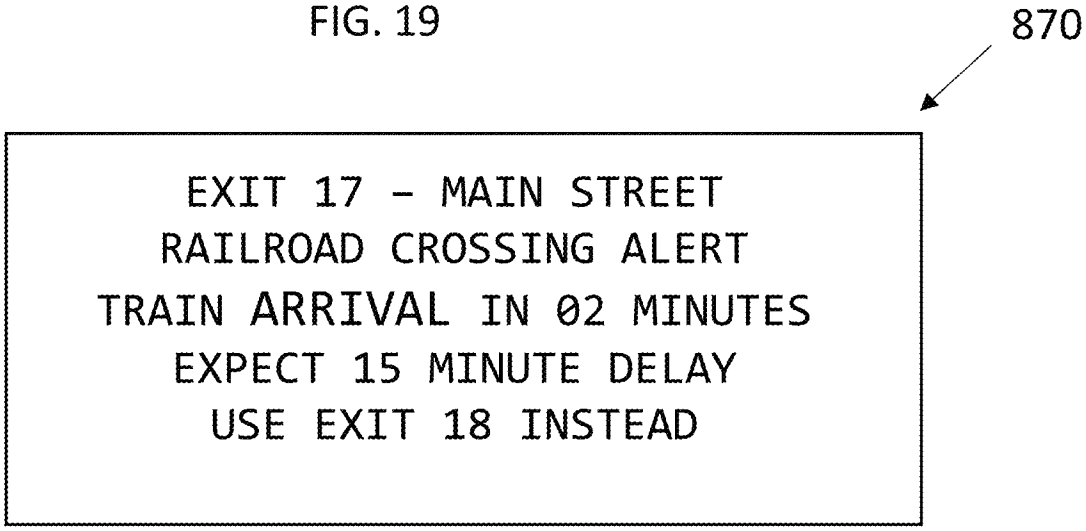
FIG. 20 illustrates an exemplary embodiment of electronic signage for the vehicle route signage system displaying a fourth crossing message.

The exemplary signage display 870 may show the message "EXIT 17—MAIN STREET", "RAILROAD CROSSING ALERT", "TRAIN ARRIVAL IN 02 MINUTES", "EXPECT 15 MINUTE DELAY", "USE EXIT 18 INSTEAD" as illustrated in FIG. 20. In contemplated embodiments, this signage display would be appropriately displayed alongside a highway. The message may be displayed in its entirety or in smaller portions that switch from one portion to the other in sequence. Such signage provides additional notification functionality including route information (Exit 17—Main Street) accessible from the highway which includes a crossing, train ETA information for the crossing along that route, blocked crossing duration estimate (expected delay) and a suggested alternative route option (e.g., Exit 18) that does not presently exist from the perspective of motorists. The signage display 870 would dynamically count down the arrive time for motorists passing by at different times. For example, one minute later from the example above, the signage display 870 may show the message "EXIT 17—MAIN STREET", "RAILROAD CROSSING ALERT", "TRAIN ARRIVAL IN 01 MINUTES", "EXPECT 15 MINUTE DELAY", "USE EXIT 18 INSTEAD". Additional signage (static or dynamic) may be provided at Exit 18 with additional detour route information.

The messages of FIGS. 19 and 20 may be alternately displayed in a dynamic manner by the same signage, in one case to count down the blocked crossing duration and in the other to count down the train ETA. At the expiration of the crossing delay period, the signage display can then turn off until subsequent predictive estimate information is received. Optionally, the signage display can message "EXIT 17—MAIN STREET", "RAILROAD CROSSING CLEAR" as an indication that neither a train nor delay is expected at the crossing.

Figure 21:
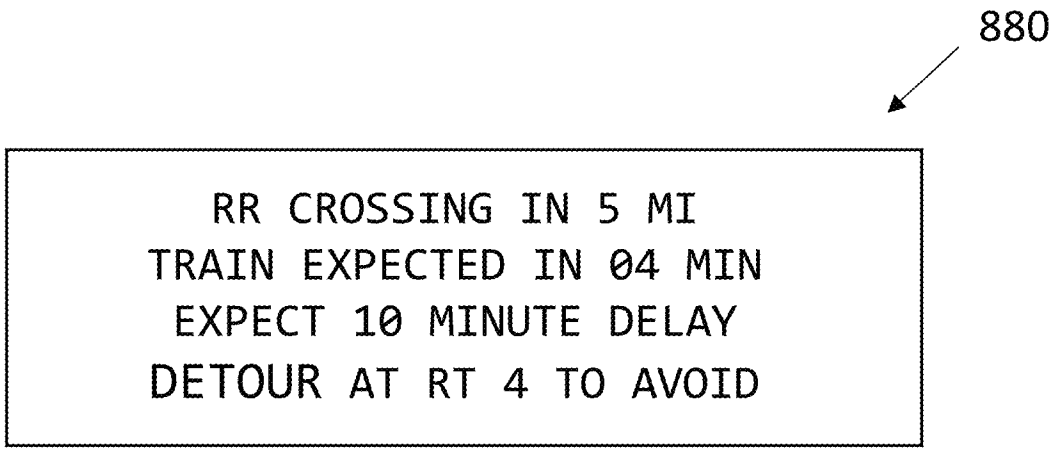
FIG. 21 illustrates an exemplary embodiment of electronic signage for the vehicle route signage system displaying a fifth crossing message.

The exemplary signage display 880 may show the message "RR CROSSING IN 5 MI", "TRAIN EXPECTED IN 04 MIN", "EXPECT 10 MINUTE DELAY", "DETOUR AT RT 4 TO AVOID" as illustrated in FIG. 21. In contemplated embodiments, this signage display would be appropriately displayed along a rural route. The message may be displayed in its entirety or in smaller portions that switch from one portion to the other in sequence. Such signage provides additional notification functionality including crossing information for the route (railroad crossing 5 miles ahead), train ETA information for the crossing ahead, blocked crossing duration estimate (expected delay) and a suggested alternative route option (e.g., Route 4) that does not presently exist from the perspective of motorists. The signage display 880 would dynamically count down the arrive time for motorists passing by at different times. For example, one minute later from the example above, the signage display 880 may show the message "RR CROSSING IN 5 MI", "TRAIN EXPECTED IN 03 MIN", "EXPECT 10 MINUTE DELAY", "DETOUR AT RT 4 TO AVOID". Additional signage (static or dynamic) may be provided along Route 4 with additional detour route information.

Figure 22:
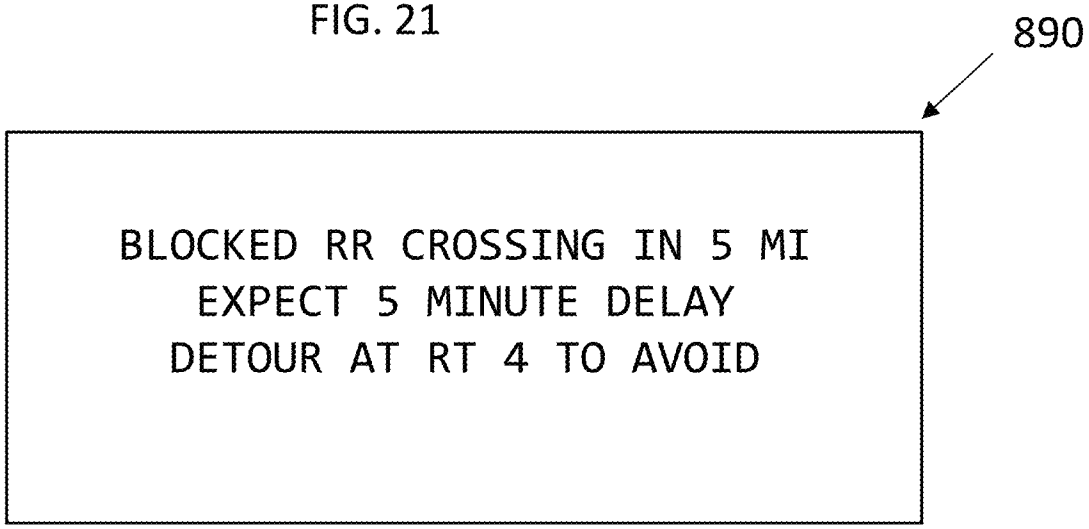
FIG. 22 illustrates an exemplary embodiment of electronic signage for the vehicle route signage system displaying a sixth crossing message.

The exemplary signage display 890 may show the message "BLOCKED RR CROSSING IN 5 MI", "EXPECT 5 MINUTE DELAY", DETOUR AT RT 4 TO AVOID" as illustrated in FIG. 22. In contemplated embodiments, this signage display would be appropriately displayed along a rural route. Such signage provides additional notification functionality including crossing status information for the route (blocked crossing 5 miles ahead), blocked crossing duration estimate (expected delay) and a suggested alternative route option (e.g., Route 4) that does not presently exist from the perspective of motorists. The signage display 890 would dynamically count down the arrive time for motorists passing by at different times. For example, one minute later from the example above, the signage display 880 may show the message "BLOCKED RR CROSSING IN 5 MI", "EXPECT 4 MINUTE DELAY", DETOUR AT RT 4 TO AVOID". Additional signage (static or dynamic) may be provided along Route 4 with additional detour route information.

The messages of FIGS. 21 and 22 may be alternately displayed in a dynamic manner by the same signage, in one case to count down the train ETA and in the other to count down the blocked crossing duration. At the expiration of the crossing delay period, the signage display can then turn off until subsequent predictive estimate information is received. Optionally, the signage display can message "RR CROSSING IN 5 MI", "CLEAR—NO TRAIN EXPECTED" as an indication that neither a train nor delay is expected at the crossing.

Via exemplary signage and messaging such as those above, drivers who wish to avoid the associated delays may decide whether to incur the delays or change routes (including but not necessarily limited to the suggested alternative routes or detours), or to take other actions to avoid delay associated with the crossings. Of course, any motorist that chooses an alternative route or takes other action would mean one less vehicle at the crossing site when the train actually arrives, and safety concerns would be reduced. Vehicles that are not present upon train arrival cannot collide with the train, and safety at the crossing is marginally improved by advance notice of the train at the crossing that is sufficient for the driver to avoid being at crossings at the same time as the trains or arriving at the crossings at about the same time.

The alphanumeric messages described above are exemplary only. Messages including other content, other order or sequences of content presented, and messages including images or symbols such as directional arrows, railroad crossbucks, and train images may be used in further messages as non-limiting examples. The messages may be generated in any suitable type of dynamic electronic signage.

Similar messages to those described above may be incorporated in and utilized by the other devices in the systems described above including without limitation to the notification devices 500, vehicle navigation systems 600 and vehicle dispatch systems 700 described above with similar benefits.

Figure 23:
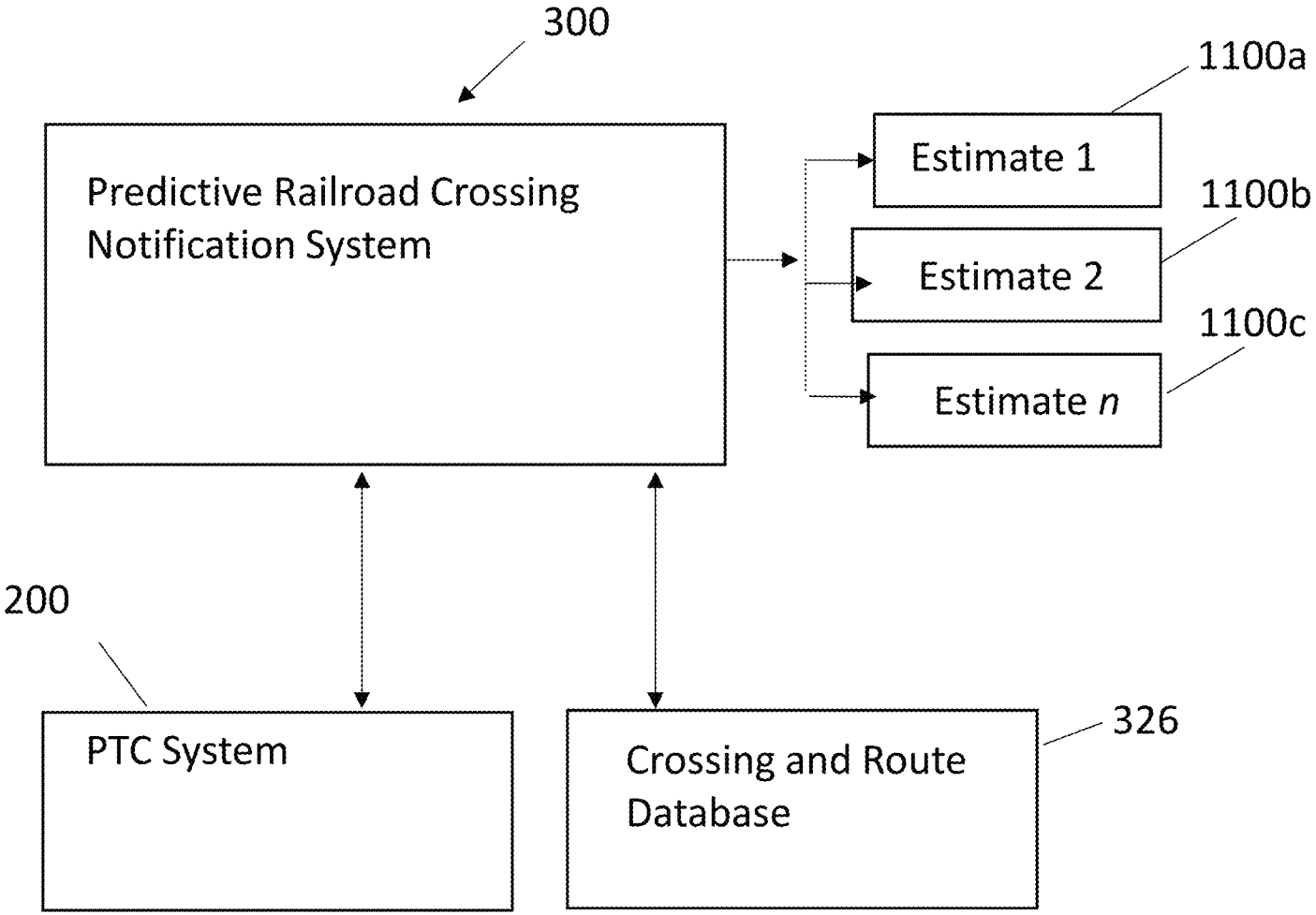
FIG. 23 schematically illustrates an operation of the predictive railroad crossing notification system.

As illustrated schematically in FIG. 23, the predictive railroad crossing system 300 is scalable to provide crossing estimate information outputs for any number n of crossings represented at 1100*a*, 1100*b*, 1100*c*. The estimates 1100*a*, 1100*b*, 1100*c* may be communicated as data inputs to any of the systems and devices described above in a generally simultaneous manner. That is, the system 300 is fully capable of around the clock, real-time operation to iteratively produce estimates at the sampled data frequency for large numbers of crossings associated with large numbers of train operating in different geographic locations, and communicate crossing-specific information to large numbers of crossing systems, vehicle navigation systems, driver notification systems, dispatch systems, traffic messaging channel systems, intelligent transportation systems, transportation management systems, and personal devices as described above.

Collectively, railroad crossing safety improvements and vehicle route enhancement and optimization may be realized by the systems described above in a more or less universally applicable manner across the immense network of roadways and public or private crossings in existence today. Reliable estimates may be generated in more or less real-time resolving the complexities presented in manner that could not be accomplished in the human mind or practically performed with pen and paper due to the intractable problems presented for a manual estimate generation for all operating trains and all identified crossings for the trains that operating simultaneously at different track locations and speeds. Crossing safety and vehicle traffic flow improvements are beneficially realized by the predictive estimates of the systems described for the vast number of crossings that presently have no active or passing warning features and for which conventional train detection systems are not economical.

While an exemplary architecture of systems and subsystems are shown and described, variations are of course possible and may be implemented in further embodiments with otherwise similar functionality. A computer server-based architecture has been shown and described for selected portions of the systems and subsystems, although server-based architectures are not necessarily required for the benefits of the invention to be obtained.

Figure 24:
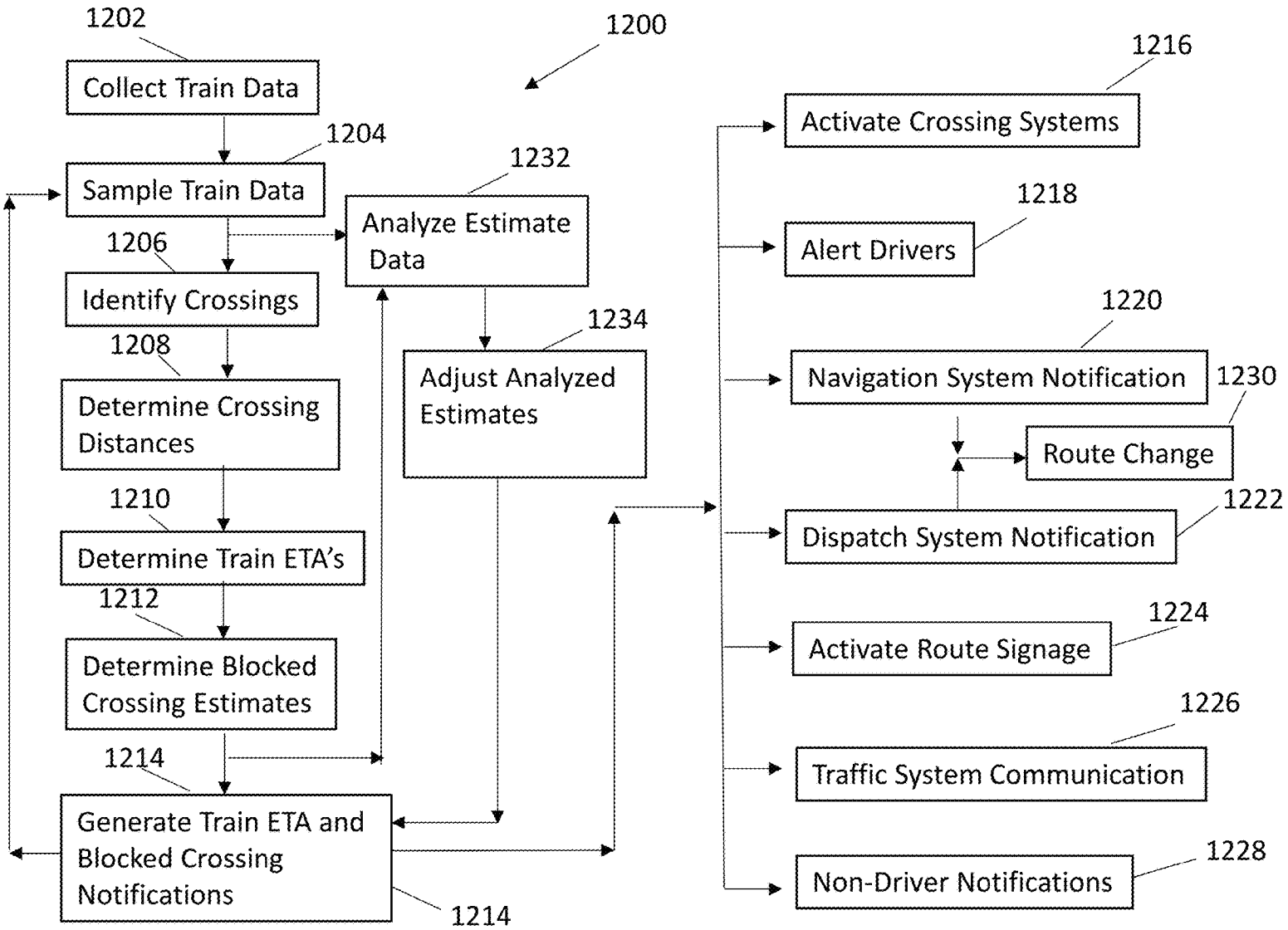
FIG. 24 is an algorithmic flowchart of exemplary processes performed by the intelligent, processor-based predictive railroad crossing notification and traffic control system of the present invention.

FIG. 24 is an algorithmic flowchart of exemplary methods, processes, and steps performed by the predictive railroad crossing notification and traffic control system 100 of the present invention. The processes 1200 illustrated in FIG. 24 include preliminary steps of providing and connecting the various process-based devices and systems such as those described above (including any enrollment of devices and users as applicable) to implement the predictive train ETA and blocked crossing duration estimates capabilities in order to improve crossing safety and roadway traffic flow to avoid inefficiencies and delay of blocked crossings. The processes 1200 presume that in each device and system of the system 100 the respective controllers, processors and memory storage include executable instructions, commands, and control algorithms to respectively and collectively perform the steps below, as well as, where needed, the controller and processors of each device and system are further placed in communication with a database or other external memory device as appropriate including additional data and information needed to accomplish the functionality described above and below.

The processes 1200 may be implemented as algorithms in the programming or engineering of the respective connected devices shown by example in FIGS. 1-23 above, although variations are possible in further and/or alternative embodiments. The technical effect of the processes and systems described herein is achieved when data and information such as that described above is entered, transmitted, received downloaded or otherwise accepted by or made available to the predictive railroad crossing system 300 via the train control system 200 and the database or databases described in the above examples in order to realize the functionality described herein.

At step 1202 real-time train data is continuously collected for various different numbers n of trains in operation at any given time by the same or different railroad entity on the same or different set of railroad tracks. The real-time train data may be collected by onboard systems of each locomotive, by physical train detection systems operative by railroad entities or third parties operative on specific portions or sections of railroad tracks (typically at and around the site of selected railroad crossings), or both as described above in relation to FIGS. 1-5 in exemplary system embodiments. In contemplated embodiments, the real-time train data is continuously collected principally by the PTC system described above, although the PTC system is not necessarily required in all embodiments to collect sufficient data for purposes of step 1202.

The real-time train data collected at step 1202 includes at least train location data, train speed data, train heading data (i.e., direction of travel data) and train length data for each respective train that is operating. Also, and as described above, the train location data is not simply and directly reported with GPS coordinates but is instead collected by Division, Subdivision, Branch and Milepost of the respective railroad corridor that each respective train is traveling upon. Variations of train data collected are, however, possible in other embodiments dependent on railroad entity willingness to supply data. As explained above, railroad operators are presently reluctant to disclose direct GPS location data for each operating train out of concern that it could be exploited by malicious persons. To the extent that railroad operators may permit it to be utilized for purposes of the systems and methods described herein, or to the extent that train GPS location data can be generated from other systems (e.g., third party train detection systems or roadway vehicle based GPS systems with user reporting features of a trains at crossings) such GPS location data may be collected for purposes of step 1202.

At step 1204, the collected data at step 1202 is sampled at a periodic time interval t which for example may be set to ten minutes. As such, every ten minutes a new data set is considered from the real-time train collection including fresh data regarding train location data, train speed data, train heading data (i.e., direction of travel data) and train length data. Elapsed time data is therefore made available for iterative performance of the steps described below. In the example systems described above, the collected data at step 1202 is output by the train control system and input to the predictive railroad crossing notification system 300 as a trusted broker of otherwise proprietary railroad data. Any mode of data communication is possible between the interfaced predictive railroad crossing notification system 300 and the train control system 200. In some cases the collected data at step 1202 may be retrieved by the predictive railroad crossing notification system 300. Other periodic time intervals t may be selected in various different embodiments. While a range of two to ten minutes is disclosed above, time intervals t of less than two minutes or greater than ten minutes are possible in various different embodiments.

At step 1206, crossings are identified that each operating train is approaching from the heading information in the sampled data that indicates crossings ahead of each train on the routes in which they are operating. The number of crossings identified may be limited as described above and the identified crossings may be public or private crossings. Identified crossings may be determined by the predictive railroad crossing notification system 300 in the manner described above referencing an external crossing database. Variations are, however, possible in other embodiments, and crossings may be identified in other ways. Any number n of crossings may identified, and since the operating trains are moving about in real-time the number n of crossings identified may change considerably at each sampled time interval.

At step 1208, a distance for each operating train location to the identified crossings is determined on a train-by-train and crossing-by-crossing basis. Exemplary determinations of distances to the crossings are described above, including accounting for Milepost to GPS coordinate data and routing information obtained from a separate database per the examples described. In the above-described examples the distances are determined by one or more centralized predictive railroad crossing notification systems 300 in a specific manner, although variations are possible. The distances are simultaneously determined at step 1208 on a train-by-train and crossing-by-crossing basis for the n number of trains operating and the n number of crossings identified at step 1206.

At step 1210, train ETA's are determined or generated based on the crossing distances determined at step 1210 and the known train speed from the data sampled at step 1204. Examples of train ETA determinations are described above, which are performed by the predictive railroad crossing notification system(s) 300 in contemplated examples. Train ETA's are simultaneously generated at step 1210 on a train-by-train and crossing-by-crossing basis for the n number of trains operating and the n number of crossings identified at step 1206.

At step 1212, blocked crossing duration estimates are determined or generated based on the known and the known train length and train speed from the data sampled at step 1204. Examples of blocked crossing duration estimates are described above, which are performed by the predictive railroad crossing notification system(s) 300 in contemplated examples. Blocked crossing duration estimates are simultaneously generated at step 1212 on a train-by-train and crossing-by-crossing basis for the n number of trains operating and the n number of crossings identified at step 1206.

The estimates generated and determined at steps 1210 and 1212 may be correlated with the time of the last data sampled per some of the above-described examples to obtain specific time estimates for the associated events at each crossing. For example, non-specific estimate information for a crossing may be train ETA of 9 minutes, expected delay of 18 minutes, while specific information for the same crossing may be train ETA 1:19 pm with blocked crossing until 1:37 pm. Specific and non-specific time estimates may be generated for different crossings as appropriate depending on the particulars of the identified crossings.

At step 1214, train ETA and blocked crossing notifications are generated. In the examples above, the notifications are generated as outputs of the predictive railroad crossing notification system(s) 300. The notifications generated are made on a crossing-by-crossing basis for the n number of trains operating and the n number of crossings identified at step 1206 and evaluated at steps 1208, 1212 and 1214. The notifications may be made provided in wireless and non-wireless modes as appropriate with crossing identifiers such that receiving devices may respond in kind. Specific communications could be made to different receiving devices and systems using different communication protocols and interfaces.

Once the estimates are generated at step 1214 the predictive railroad crossing notification system(s) 300 in the above examples returns to step 1204 and awaits the next sampled data interval. Based on the refreshed or update data at the next time interval steps 1206 through 1214 are again performed. Iterative estimates are generated in contemplated examples by the predictive railroading crossing notification system(s) 300, with estimate data stored by the predictive railroad crossing notification system(s) 300 at each iteration.

Estimates generated at step 1214 at each iteration are received by systems and devices external to the centralized predictive railroad crossing notification system(s) 300 to realize significant benefits that were not heretofore possible via actions taken and decisions that are enabled by the receiving devices and systems in the following steps.

At step 1216, crossing systems at the respective identified crossings may be activated that are responsive to the estimates generated at step 1214. Active warning system capability may be realized at crossings that may be retrofitted with low cost crossing systems such as those described above in relation to FIGS. 6 and 7 where railroad operating train detection or active warning systems have not been installed and where existing third party train detection systems are not economically provided such as remote crossing locations where commercial power supply cabling does not exist. Additional functionality may also be realized at crossings with existing active warning systems but that lack any predictive capability that the systems and methods of the invention enables. As described above, solar powered crossing systems may be beneficially used, and signage local to the crossing may be utilized that communicate train ETA and blocked crossing estimate information to drivers and persons at the crossing site, optionally with suggested route and detour information as well to avoid travel delays.

At step 1218, driver alerts are generated to notify drivers of pertinent predictive crossing estimate information as the identified crossings are approached. Examples of driver notification devices that are responsive to the pertinent predictive crossing estimates generated at step 1214 are described above as non-limiting examples.

At step 1220, navigation system notifications are generated to notify users of pertinent crossing estimate information in the selection of a route or as the identified crossings are approached. Examples of navigation systems and devices that may be responsive to the pertinent predictive crossing estimates generated at step 1214 are described above as non-limiting examples. In some cases, hardware-enabled alert systems can be provided in tandem with the receiving devices which receive data transmissions and security codes from the trusted broker system 300 in the system examples above to access and decrypt targeted messages to each receiving device for response to generated train ETA estimate and blocked crossing duration estimate information.

At step 1222, vehicle dispatch system notifications are generated as input pertinent crossing estimate information in the selection of a route or as the identified crossings are approached by dispatched vehicles. Examples of vehicle dispatch systems and devices that may be responsive to the pertinent predictive crossing estimates generated at step 1214 are described above as non-limiting examples.

At step 1224, roadway signage is activated in response to the pertinent predictive crossing estimates generated at step 1214. Electronic signage with detailed and dynamic messaging capability are described above as non-limiting examples, some of which include alternative route information or detour information to avoid travel delays.

At step 1226, traffic communication system actions are taken in response to the pertinent predictive crossing estimates generated at step 1214. For example, TMC and ITS systems, among other possibilities may further broadcast crossing status and estimate information for the benefit of the greater motoring public.

At step 1228, non-driver notifications may be made to personal devices of passengers in vehicles, workers at crossing sites, pedestrians, etc. that are not driving a vehicle but may take desired actions in response to the notifications made possible via the pertinent predictive crossing estimates generated at step 1214. In various different embodiments the personal devices may be portable electronic devices such as smartphones, smart watches, tablet devices and laptop or notebook computer devices as non-limiting examples. As such, a user via a personal device could, for example, check and verify in advance that a crossing along a route that he/she intends to traverse is not going to be blocked. A person, who may be a non-driver for the route of interest, may receive verification from the system that the route will be clear, but in a manner that does not require mapping the travel into a navigational aid system.

The notifications and actions associated with steps 1216, 1218, 1220, 1222, 1224, 1226 and 1228 may be made simultaneously to a host of crossing systems, drivers, vehicles with operating navigation systems, dispatch systems, route signage, traffic communication systems and personal non-driver devices. Comprehensive redundancy is provided for broad dissemination of predictive crossing status to large segments of the interested population in different ways to facilitate proactive decision making to avoid blocked crossings with significant benefit to the public at large. In some cases, and as illustrated at step 1230, route changes may be automatically undertaken by certain devices and systems as shown in non-limiting examples by navigation systems and dispatch systems, with or without transparency to drivers or users regarding why specific routing decisions or rerouting have been made.

As illustrated at steps 1232 and 1234, the pertinent train ETAs and blocked crossing estimates are optionally analyzed via comparison to earlier estimate data and physical sensor data that facilitates information feedback to assess the performance and accuracy of the predictive crossing status and estimate information generated. Patterns can be identified in the data over time which may provide a basis to make adjustments in the predicted data values such that the predictive estimates can become more accurate over time and in some cases the predictive estimates may converge with real-world physical train detection events at identified crossings. Machine learning and artificial intelligence may inform the analysis and adjustments at steps 1232 and 1234 to minimize error in predicated estimates generally and to reported estimates specifically for the notifications generated at step 1214.

The above-described embodiments of the disclosure may be implemented using computer programming or engineering techniques including computer software, firmware, hardware or any combination or subset thereof, wherein the technical effects described above are achieved. Any such resulting program, having computer-readable code means, may be embodied or provided within one or more computer-readable media, thereby making a computer program product, (i.e., an article of manufacture), according to the embodiments described above. The computer-readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

Such computer programs (also known as programs, software, software applications, "apps", or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The "machine-readable medium" and "computer-readable medium," however, do not include transitory signals. The term "machine-readable signal" refers to any signal used to provide machine instructions and/or data to a programmable processor.

The applications described above are flexible and designed to run in various different environments without compromising any major functionality. In some embodiments, the system includes multiple components distributed among a plurality of processor-based devices. One or more components are in the form of computer-executable instructions embodied in a computer-readable medium. The systems and processes are not limited to the specific embodiments described herein. In addition, components of each system and each process can be practiced independently and separately from other components and processes described. Each component and process can also be used in combination with other components and other processes.

One or more computer-readable storage media may include computer-executable instructions embodied thereon for the computer devices described. For example, the predictive railroad crossing notification system 300 as described may include a memory device and a processor in communication with the memory device, and when executed by the processor in each respective device the computer-executable instructions may cause the processor to perform one or more algorithmic steps of a method such as the method described and illustrated in the example of FIG. 24 and other algorithmic features accompanying the inventive systems and sub-systems described in FIGS. 1-23. Specifically, the predictive railroad crossing notification system 300 described may include a memory device and a processor in communication with the memory device, and when executed by the processor in each respective device the computer-executable instructions may cause the processor to perform the algorithmic steps described above to provide desired train ETA and blocked crossing duration estimates and any control decision or response to estimate information generated. In other embodiments, however, the functionality of the predictive railroad crossing notification system 300 may be distributed amongst multiple ones of the other devices and systems represented in the system 100.

Having described devices and applicable operating algorithms functionally per the description above, those in the art may accordingly implement the algorithms via programming of the processor-based computing devices. Such programming or implementation of the concepts described is believed to be within the purview of those in the art and will not be described further.

The benefits and advantages of the inventive systems and methods are now believed to have been amply illustrated in relation to the exemplary embodiments disclosed.

An embodiment of a predictive railroad crossing system has been disclosed that is operable with respect to a plurality of operating trains to proactively improve railroad safety notification and traffic control decisions to avoid crossing-associated delays for each of the plurality of operating trains. The predictive railroad crossing system includes at least one processor-based device configured to iteratively respond to real-time operating data for each of the plurality of operating trains and identify one or more public or private railroad crossings that each respective one of the plurality of operating trains will approach. The at least one processor-based device is further configured to estimate a time of arrival for each respective one of the plurality of operating trains at each of the respectively identified one or more public or private railroad crossings, and estimate a blocked crossing duration time after an arrival each respective one of the plurality of operating trains at each of the respectively identified one or more public or private railroad crossings, wherein the estimated time of arrival and the estimated of blocked crossing duration time is made predictively for each of the respectively identified one or more public or private railroad crossings without any physical train detection in at least some of the identified one or more public or private railroad crossings.

Optionally, the system may further include a train control system including sets of real-time operating data for each of the plurality of trains of one or more railroad entities. The train control system may be a positive train control system. Each set of real-time operating data may include location data, train speed data, train heading data, and train length data for each of the plurality of trains. The train location data may include railroad corridor division data, subdivision data, branch data, and milepost data. The at least one processor-based device may be configured to compute a distance to each of the respectively identified one or more public or private railroad crossings based on a conversion of milepost data to global positioning system data. The system may also include at least one database including route correlation information, the distance to each of the respective identified crossings further being based on the route correlation information.

As further options, the system may include a processor-based crossing system operating on a site of at least one of the identified one or more public or private railroad crossings, the processor-based crossing system operationally responsive to the estimated time of arrival and the estimated of blocked crossing duration time applicable to the site in order to operate at least one crossing safety device. The at least one processor-based crossing system may be solar powered. The processor-based crossing warning system may be configured to present the estimated time of arrival or the estimated of blocked crossing duration time at the site.

The system may optionally further include a processor-based electronic signage alongside at least one roadway route associated with one of the identified one or more public or private railroad crossings, the electronic signage configured to display a message including the estimated time of arrival or the estimated of blocked crossing duration time for one of the identified public or private railroad crossings. The message may optionally include suggested route information or detour information to avoid one of the identified public or private railroad crossings.

The system may optionally further include at least one processor-based driver notification device responsive to the estimated time of arrival or the estimated of blocked crossing duration time for one of the of the identified public or private railroad crossings.

The system may optionally further include at least one processor-based vehicle navigation system responsive to the estimated time of arrival or the estimated of blocked crossing duration time for one of the of the identified public or private railroad crossings to provide an alert or to effect a change in route.

The system may optionally further include at least one processor-based vehicle dispatch system responsive to the estimated time of arrival or the estimated of blocked crossing duration time for one of the of the identified public or private railroad crossings to provide an alert or to effect a change in route.

The system may optionally further include at least one processor-based personal device, the at least one personal device responsive to the estimated time of arrival or the estimated of blocked crossing duration time for one of the of the identified public or private railroad crossings to provide a crossing status or to effect a change in route.

The system may optionally further include at least one processor-based transportation system responsive to the estimated time of arrival or the estimated of blocked crossing duration time for one of the of the identified public or private railroad crossings to provide at least one of an alert or to effect a change in route. The at least one processor-based transportation system may include a traffic channel messaging system or an intelligent transportation system.

Optionally, the at least one processor-based device may further be configured to compare the estimated time of arrival and the estimated of blocked crossing duration time with previously determined estimated time of arrival and the estimated of blocked crossing duration time for the identified one or more public or private railroad crossings.

The at least one processor-based device may also optionally be further configured to compare the estimated time of arrival and the estimated of blocked crossing duration time with sensed train data applicable to the identified one or more public or private railroad crossings.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A predictive railroad crossing system operable with respect to a plurality of operating trains to proactively improve railroad safety notification or traffic control decisions to avoid crossing-associated delays attributable to each of the plurality of operating trains for the benefit of interested persons affected by the plurality of operating trains along railroad corridors, the predictive railroad crossing system comprising:

at least one processor-based device configured to iteratively respond to real-time operating data for each of the plurality of operating trains and identify one or more public or private railroad crossings that each respective one of the plurality of operating trains will approach;

wherein the at least one processor-based device is further configured to:

estimate a time of arrival for each respective one of the plurality of operating trains at each of the respectively identified one or more public or private railroad crossings; and estimate a blocked crossing duration time after an arrival of each respective one of the plurality of operating trains at each of the respectively identified one or more public or private railroad crossings;

wherein the estimated time of arrival and the estimated blocked crossing duration time are made predictively for each of the respectively identified one or more public or private railroad crossings without any physical train detection in at least one of the identified one or more public or private railroad crossings.

2. The system of claim 1, further comprising a train control system including sets of real-time operating data for each of the plurality of trains of one or more railroad entities.

3. The system of claim 2, wherein the train control system is a positive train control system.

4. The system of claim 3, wherein each set of real-time operating data includes location data, train speed data, train heading data, and train length data for each of the plurality of trains.

5. The system of claim 4, wherein the train location data includes railroad corridor division data, subdivision data, branch data, and milepost data.

6. The system of claim 5, wherein the at least one processor-based device is configured to compute a distance to each of the respectively identified one or more public or private railroad crossings based on a conversion of milepost data to global positioning system data.

7. The system of claim 6, further comprising at least one database including route correlation information, the distance to each of the respective identified crossings further being based on the route correlation information.

8. The system of claim 1, further comprising a processor-based crossing system operating on a site of at least one of the identified one or more public or private railroad crossings, the processor-based crossing system operationally responsive to the estimated time of arrival and the estimated blocked crossing duration time applicable to the site in order to operate at least one crossing safety device.

9. The system of claim 8, wherein the at least one processor-based crossing system is solar powered.

10. The system of claim 8, wherein the processor-based crossing warning system is configured to present the estimated time of arrival or the estimated blocked crossing duration time at the site.

11. The system of claim 8, wherein the at least one crossing safety device comprises at least one warning light.

12. The system of claim 11, wherein the at least one warning light is an LED.

13. The system of claim 11, wherein the at least one warning light is solar-powered.

14. The system of claim 11, wherein the at least one warning light is battery powered.

15. The system of claim 11, wherein the at least one warning light is a static warning light or a dynamic warning light.

16. The system of claim 11, further comprising a crossbuck, the at least one warning light provided on the crossbuck.

17. The system of claim 11, wherein the at least one crossing safety device comprises an audio alert device.

18. The system of claim 11, wherein the at least one crossing safety device comprises a barrier device.

19. The system of claim 1, further comprising at least one processor-based driver notification device responsive to the estimated time of arrival or the estimated blocked crossing duration time for one of the identified public or private railroad crossings.

20. The system of claim 1, further comprising at least one processor-based vehicle navigation system responsive to the estimated time of arrival or the estimated blocked crossing duration time for one of the identified public or private railroad crossings to provide an alert or to effect a change in route.

21. The system of claim 1, further comprising at least one processor-based vehicle dispatch system responsive to the estimated time of arrival or the estimated blocked crossing duration time for one of the e-the-identified public or private railroad crossings to provide an alert or to effect a change in route.

22. The system of claim 1, further comprising at least one processor-based transportation system responsive to the estimated time of arrival or the estimated blocked crossing duration time for one of the identified public or private railroad crossings to provide at least one of an alert or to effect a change in route.

23. The system of claim 22, wherein the at least one processor-based transportation system includes a traffic channel messaging system or an intelligent transportation system.

24. The system of claim 1, wherein the at least one processor-based device is further configured to compare the estimated time of arrival and the estimated blocked crossing duration time with a previously determined estimated time of arrival and a previously determined estimated blocked crossing duration time for the identified one or more public or private railroad crossings.

25. The system of claim 1, wherein the at least one processor-based device is further configured to compare the estimated time of arrival and the estimated blocked crossing duration time with sensed train data applicable to the identified one or more public or private railroad crossings.

26. The system of claim 1, wherein the estimated time of arrival is made predictively at least 10 minutes in advance for at least one of the respectively identified one or more public or private railroad crossings.

27. The system of claim 26, wherein the estimated time of arrival is made predictively at least 20 minutes in advance for at least one of the respectively identified one or more public or private railroad crossings.

28. The system of claim 1, wherein the estimated time of arrival is made predictively while at least one of the plurality of operating trains is at least 10 miles away from one of the respectively identified one or more public or private railroad crossings.

29. The system of claim 28, wherein the estimated time of arrival is made predictively while at least one of the plurality of operating trains is at least 20 miles away from one of the respectively identified one or more public or private railroad crossings.

30. The system of claim 1, in combination with an active or passive crossing system operating on a site of at least one of the identified one or more public or private railroad crossings.

31. The system of claim 1, wherein the at least one processor-based device is further configured to communicate the estimated time of arrival and the estimated blocked crossing duration time $t_0$ a location of a person traveling toward or already in the vicinity of at least one of the identified one or more public or private railroad crossings.

32. The system of claim 1, wherein the interested persons include a driver, a passenger, a railroad worker, a pedestrian, a biker, and a hiker.

33. The system of claim 1, wherein the at least one processor-based device comprises a computer server device.

34. A predictive railroad crossing system operable with respect to a plurality of operating trains to proactively improve railroad safety notification or traffic control decisions to avoid crossing-associated delays attributable to each of the plurality of operating trains for the benefit of interested persons affected by the plurality of operating trains along railroad corridors, the predictive railroad crossing system comprising:

at least one processor-based device configured to iteratively respond to real-time operating data for each of the plurality of operating trains and identify one or more public or private railroad crossings that each respective one of the plurality of operating trains will approach;

wherein the at least one processor-based device is further configured to:

estimate a time of arrival for each respective one of the plurality of operating trains at each of the respectively identified one or more public or private railroad crossings; and estimate a blocked crossing duration time after an arrival of each respective one of the plurality of operating trains at each of the respectively identified one or more public or private railroad crossings;

wherein the estimated time of arrival and the estimated blocked crossing duration time are made predictively for each of the respectively identified one or more public or private railroad crossings without any physical train detection in at least one of the identified one or more public or private railroad crossings; and processor-based electronic signage alongside at least one roadway route associated with one of the identified one or more public or private railroad crossings, the electronic signage configured to display a message including the estimated time of arrival or the estimated blocked crossing duration time for one of the identified public or private railroad crossings.

35. The system of claim 34, wherein the message further includes suggested route information or detour information to avoid one of the identified public or private railroad crossings.

36. A predictive railroad crossing system operable with respect to a plurality of operating trains to proactively improve railroad safety notification or traffic control decisions to avoid crossing-associated delays attributable to each of the plurality of operating trains for the benefit of interested persons affected by the plurality of operating trains along railroad corridors, the predictive railroad crossing system comprising:

at least one processor-based device configured to iteratively respond to real-time operating data for each of the plurality of operating trains and identify one or more public or private railroad crossings that each respective one of the plurality of operating trains will approach;

wherein the at least one processor-based device is further configured to:

estimate a time of arrival for each respective one of the plurality of operating trains at each of the respectively identified one or more public or private railroad crossings; and estimate a blocked crossing duration time after an arrival of each respective one of the plurality of operating trains at each of the respectively identified one or more public or private railroad crossings;

wherein the estimated time of arrival and the estimated blocked crossing duration time are made predictively for each of the respectively identified one or more public or private railroad crossings without any physical train detection in at least one of the identified one or more public or private railroad crossings; and at least one processor-based personal device, the at least one personal device responsive to the estimated time of arrival or the estimated blocked crossing duration time for one of the identified public or private railroad crossings to provide a crossing status or to effect a change in route.

37. The system of claim 36, wherein the at least one processor-based personal device is a smartphone.

38. The system of claim 36, wherein the crossing status is provided to a non-driver via the processor-based personal device.

39. The system of claim 36, wherein the estimated time of arrival is provided via the processor-based personal device to at least one railroad worker who is present at or near one of the respectively identified one or more public or private railroad crossings.

40. A railroad crossing system operable with respect to a plurality of operating trains, the system comprising:

at least one processor-based device configured to:

predictively determine, without requiring a train-detection system at each of a plurality of different railroad crossings, an estimated time of train arrival and a respective estimated duration of blocked crossing for all of the plurality of different railroad crossings affected by a respective one of the plurality of trains on approach; and communicate the estimated time of train arrival and a respective estimated duration of blocked rail crossing to locations of persons traveling toward or already in the vicinity of one or more of the plurality of different railroad crossings, whereby an ample lead time is provided to make a decision and take an action to avoid the train on approach at one or more of the plurality of different railroad crossings.

41. The system of claim 40, wherein the predictively determined estimated time of train arrival and the respective estimated duration of blocked crossing for all of the plurality of different railroad crossings affected by a respective one of the plurality of trains on approach are based on train position data communicated from a Positive Train Control system, train velocity data communicated from the Positive Train Control system, train length data communicated from the Positive Train Control system, and a computed distance between a current train position for the plurality of operating trains on approach to one or more of the plurality of different railroad crossings.

42. The system of claim 40, further comprising processor-based electronic signage alongside at least one roadway route associated with one of the plurality of different railroad crossings, the processor-based electronic signage configured to display the predictively determined estimated time of train arrival and the respective estimated duration of blocked crossing for the one of the plurality of different railroad crossings.

43. The system of claim 42, wherein the processor-based electronic signage is further configured to display suggested route information or detour information to avoid the train on approach at the one of the plurality of different railroad crossings.

44. The system of claim 40, further comprising at least one processor-based personal device, the at least one personal device responsive to the estimated time of arrival or the estimated blocked crossing duration time for one of the identified public or private railroad crossings to provide a crossing status or to effect a change in route.

45. The system of claim 44, wherein the at least one processor-based personal device is a smartphone.

46. The system of claim 44, wherein the at least one processor-based personal device is a wearable device.

47. The system of claim 46, wherein the wearable device is a smart watch.

48. The system of claim 40, further comprising at least one warning light that is responsive to the communication of the estimated time of train arrival at a location affected by a respective one of the plurality of trains on approach.

49. An estimation system for a plurality of railroad crossings, the system comprising:

at least one processor-based device configured to:

predictively determine an estimated time of train arrival and a corresponding estimated duration of blocked crossing for each of the plurality of railroad crossings in advance of an actual arrival of an operating train, wherein at one or more of the plurality crossings no railroad-operated train detection system exists; and communicate the predictively determined estimated time of train arrival and the predictively determined estimated duration of blocked rail crossing to persons traveling toward or already in the vicinity of any of the plurality of railroad crossings in order to make a decision and take an action to improve personal safety or avoid a personal delay associated with a blocked crossing.

50. The system of claim 49, further comprising at least one processor-based vehicle navigation system responsive to the estimated time of arrival or the estimated blocked crossing duration time for one of the identified public or private railroad crossings to provide an alert or to effect a change in route.

51. The system of claim 49, in combination with another processor-based device receiving the communicated predictively determined estimated time of train arrival and the predictively determined estimated duration of blocked rail crossing and taking an action to avoid idled traffic proximate one of the identified public or private railroad crossings.

52. The system of claim 49, further comprising at least one processor-based vehicle dispatch system responsive to the estimated time of arrival or the estimated blocked crossing duration time for one of the identified public or private railroad crossings to provide an alert or to effect a change in route.

53. A computer-implemented estimation system for persons potentially affected by a plurality of railroad crossings each including an intersection of railroad tracks and a roadway, the system comprising:

a first processor-based device at a first centralized location, the first processor-based device configured to predictively estimate, with respect to each one of the plurality of railroad crossings, a time arrival of a train at the railroad crossing and a duration of blockage of the roadway by the train after arrival at the railroad crossing, wherein at one or more of the plurality of railroad crossings no train detection capability is present; and a second processor-based device at a second location remote from the first location, the second processor-based device being configured to receive the predictively estimated time of train arrival and duration of blocked rail crossing in order to address a risk of delay in travel on the roadway or a risk of safety at the railroad crossing posed by the train at a time starting from the estimated time of arrival through an expiration of the blocked crossing duration.

54. The system of claim 53, wherein the second processor-based device is a processor-based vehicle navigation system responsive to the received predictively estimated time of train arrival and duration of blocked rail crossing to provide an alert or to effect a change in route.

55. The system of claim 53, wherein the second processor-based device is configured to take an action to avoid idled traffic proximate one of the identified public or private railroad crossings.

56. The system of claim 53, wherein the second processor-based device is a processor-based vehicle dispatch system responsive to the estimated time of arrival or the estimated blocked crossing duration time for one of the identified public or private railroad crossings to provide an alert or to effect a change in route.

57. A computer-implemented estimation system for persons navigating in an area a plurality of railroad crossings successively distanced from one another and each including an intersection of railroad tracks and a roadway, the system comprising:

a centralized processor-based device configured to iteratively sample detected information concerning the operation of at least one locomotive along the railroad tracks, the sampled detected information including location data, speed data, and train length data;

wherein the centralized processor-based device is further configured to:

based on the received location data, determine a distance to each one of the plurality of railroad crossings;

based on the determined distances and the speed data, predictively estimate a time of arrival of the train for each one of the plurality of railroad crossings; and based on the speed data and the train length data, predictively estimate a blocked crossing duration for each one of the plurality of railroad crossings; and a plurality of processor-based devices remotely located from the centralized processor based device and each receiving the predictively estimated time of arrival of the train and blocked crossing duration for respectively different ones of the plurality of railroad crossings, thereby facilitating specific decisions and actions to be taken in advance of the respective predictively estimated time of arrival of the train to improve safety on the roadway at each of the plurality of railroad crossings or to avoid blocked roadways during the predictively estimated blocked crossing duration at each of the plurality of crossings.

58. The system of claim 57, wherein the iteratively sampled detected information concerning the operation of at least one locomotive along the railroad tracks is generated by a Positive Train Control system.

59. The system of claim 57, wherein the centralized processor-based device determines a distance to each one of the plurality of railroad crossings based on Milepost Data that is converted to equivalent global position location data.

60. The system of claim 57, wherein the centralized processor-based device is further configured to compare the predictively estimated time of arrival of the train for each one of the plurality of railroad crossings to an actual time of arrival of the train for each one of the plurality of railroad crossings.

61. The system of claim 57, wherein the centralized processor-based device is further configured to compare the predictively estimated blocked crossing duration for each one of the plurality of railroad crossings to an actual blocked crossing duration for each one of the plurality of railroad crossings.

* * * * *